US006375192B1

(12) United States Patent
Uchiyama et al.

(10) Patent No.: US 6,375,192 B1
(45) Date of Patent: Apr. 23, 2002

(54) MOVING OBJECT RESTORER

(75) Inventors: Satoshi Uchiyama; Hideki Kotani, both of Kobe; Tomohisa Tanaka, Miki; Atsushi Yamazaki, Kobe; Yoshikazu Matsui, Akashi; Masakazu Shibamiya, Kobe; Takashi Honda, Suita, all of (JP)

(73) Assignee: Konami Co., Ltd., Tokyo-to (JP)

( * ) Notice: Subject to any disclaimer, the term of this patent is extended or adjusted under 35 U.S.C. 154(b) by 0 days.

(21) Appl. No.: 09/545,451

(22) Filed: Apr. 7, 2000

(30) Foreign Application Priority Data

Apr. 9, 1999 (JP) ..... 11-102824

(51) Int. Cl.[7] ..... A63F 9/02; F42B 6/04; G07C 15/00

(52) U.S. Cl. ..... 273/331; 273/394

(58) Field of Search ..... 273/329, 330, 273/331, 348, 394, 395, 396, 397, 317.8, 127 C, 108, 118 R; 473/423, 431

(56) References Cited

U.S. PATENT DOCUMENTS 1,127,279 A * 2/1915 Ramsey ..... 273/317.8 X
3,168,312 A * 2/1965 Davis ..... 473/423
4,129,110 A * 12/1978 Kubrak ..... 473/423 X
4,278,257 A * 7/1981 Garcia et al. ..... 473/423

FOREIGN PATENT DOCUMENTS

| | | | |
|---|---|---|---|
| JP | 44-3643 | 2/1944 | |
| JP | 52-76765 | 12/1980 | |
| JP | 9-262365 | 10/1997 | |
| JP | 2000-271341 | * 10/2000 | ..... A63F/9/00 |

* cited by examiner

*Primary Examiner*—Raleigh W. Chiu
(74) *Attorney, Agent, or Firm*—Jordan and Hamburg LLP

(57) ABSTRACT

A moving object restorer is provided with a connecting cord having one end held at a fixed position and the other end connected with a moving object, a guiding member fixedly provided between the moving object and the fixed position for guiding the connecting cord, a regulator movably provided between the guiding member and the fixed position and having a holder portion for holding the connecting cord slidably. The regulator is movable between a first position for allowing the moving object to be moved and a second position for holding the moving object in a restored position.

11 Claims, 23 Drawing Sheets

MOVING OBJECT RESTORER

BACKGROUND OF THE INVENTION

The present invention relates to a moving object restorer for restoring a moving object to an original position.

FIGS. 24A to 24C show a conventional restoring process for restoring a moving object. As shown in FIG. 24A, a moving object 103 or rocket is set in a shooter 101 disposed in an original position W. In this state, a regulator 105 connected with the moving object 103 by a cord 106 is stayed at a first position P1 on a rail 104 along which the regulator 105 runs, and the cord 106 is entirely loosened. After being shot by the shooter 101, the moving object 103 flies toward a terminal position O where a target 102 is disposed as shown in FIG. 24B. The moving object 103 is restored from the terminal position O to the original position W by moving the regulator 105 from the first position P1 to a second position P2 to thereby pull the cord 106 as shown in FIG. 24C. Indicated at 107 is a detector for detecting the presence of the moving object 103 at the original position W.

In the restorer, the cord 106 has a length longer than a necessary length to ensure free fly of the moving object 103. As shown in FIG. 24B, even in the state in which the moving object 103 reaches the target 102, the cord 106 has a loosing portion. To compensate for this loosing portion in the restoration, accordingly, it is required to make the running range between the first position P1 and the second position P2 longer than a necessary range. In some cases, the second position P2 on the rail 104 is beyond the terminal position O, consequently increasing the length of the rail 104. This increase will undesirably increase the entire size of an assembly, such as game machine, accommodating the moving object restorer.

SUMMARY OF THE INVENTION

It is an object of the present invention to provide a moving object restorer which is free of the problems residing in the prior art.

According to an aspect of the present invention, a moving object restorer is provided with a slender connecting member having one end held at a fixed position and the other end connected with a moving object, a guiding member fixedly provided between the moving object and the fixed position for guiding the slender connecting member, and a regulator movably provided between the guiding member and the fixed position and having a holder portion for holding the slender connecting member slidably. The regulator is movable between a first position for allowing the moving object to be moved and a second position for holding the moving object in a restored position. The moving object is moved in a restoring direction by moving the regulator in the direction opposite to the restoring direction.

These and other objects, features, aspects, and advantages of the present invention will become more apparent from the following detailed description of the preferred embodiments/examples.

DETAILED DESCRIPTION OF THE PREFERRED EMBODIMENTS OF THE INVENTION

Figure 23A:
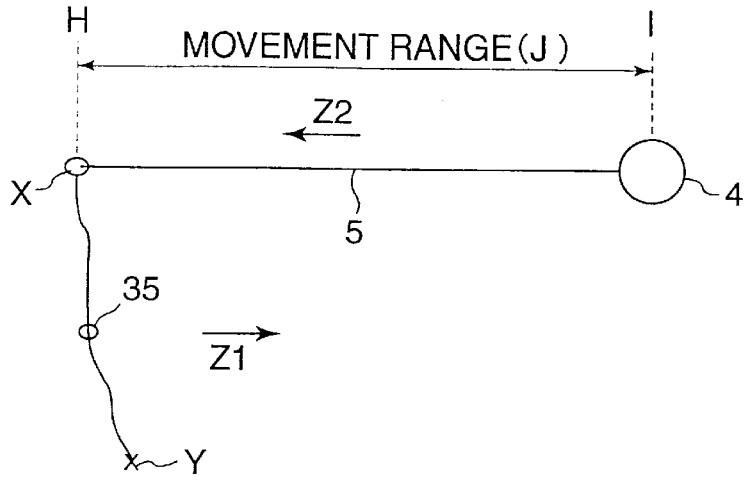
FIGS. 23A to 23C are diagrams illustrating a basic operation for restoration in the invention.

First of all, a basic operation for moving object restoration in the invention will be described with reference to FIGS. 23A to 23C. In FIG. 23A, a moving object 4 is movable within a movement range J from an original position H to an extreme moved position I. The moving object 4 is connected with a connecting cord 5 whose extreme end is held at a fixing position Y. The connecting cord 5 is passed through a guide X and a cord regulator 35.

Figure 23B:
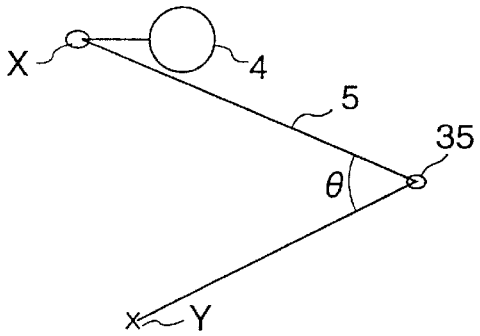

In FIG. 23B, moving the cord regulator 35 in the direction of the arrow Z1 increases the length of the connecting cord 5 from the fixing position Y to the cord regulator 35 and the length of the connecting cord 5 from the guide X to the cord regulator 35, but decreases the length of the connecting cord 5 from the moving object 4 to the guide X to thereby move the moving object 4 in the direction of the arrow Z2, finally restoring the moving object 4 into the original position H. Thereafter, as shown in FIG. 23C, the cord regulator 35 is moved back to allow the moving object 4 to freely move.

Figure 23C:
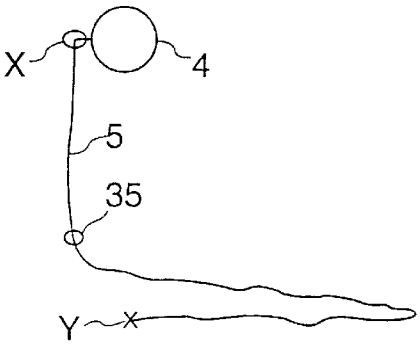
Figure 24A:
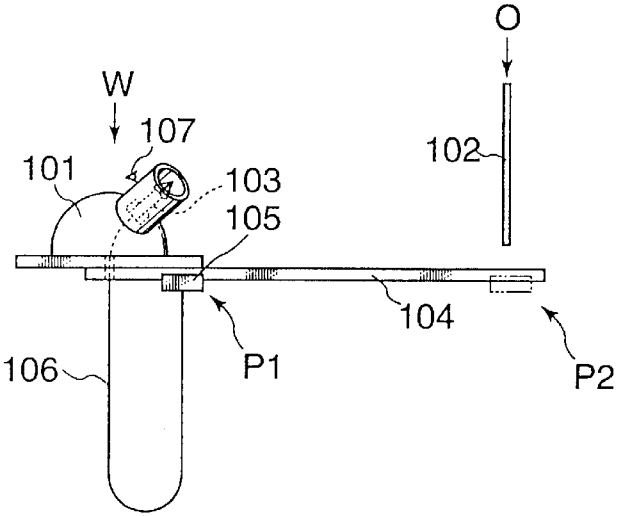
PRIOR ART FIG. 24A
FIGS. 24A to 24C are diagrams illustrating a basic operation of a conventional moving object restorer.
Figure 24B:
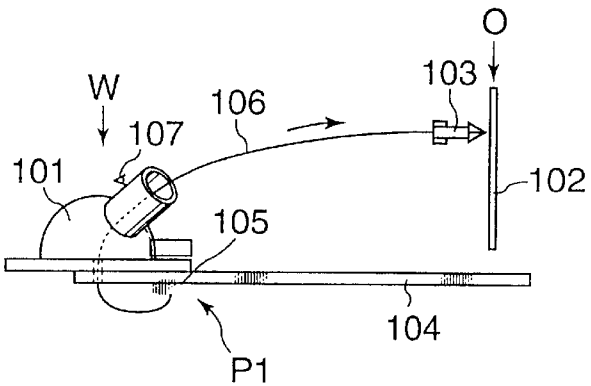
Figure 24C:
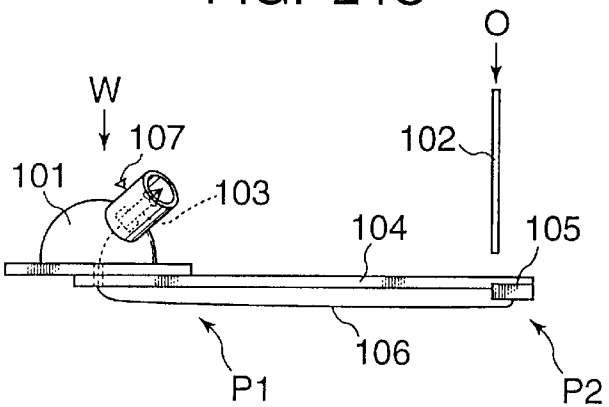

It will be seen from FIGS. 23A to 23C that the moving object 4 can be restored from the extreme moved position I to the original position H by moving the cord regulator 35 smaller than the movement range J, about a half of the movement range J. Also, it will be seen that comparing with a case where the distance between the guide X and the fixing position Y is longer, the ratio of a moved amount of the moving object 4 in the Z2-direction to a moved amount of the cord regulator 35 in the Z1-direction is greater in a case where the distance between the guide X and the fixing position Y is shorter. In other words, it would be preferable to reduce the distance between the fixing position Y and the guide X as small as possible. Further, the cord regulator 35 is not limited to be moved in a parallel direction with the movement direction of the moving object 4, but may be moved in a direction intersecting the movement direction of the moving object 4.

Figure 1:
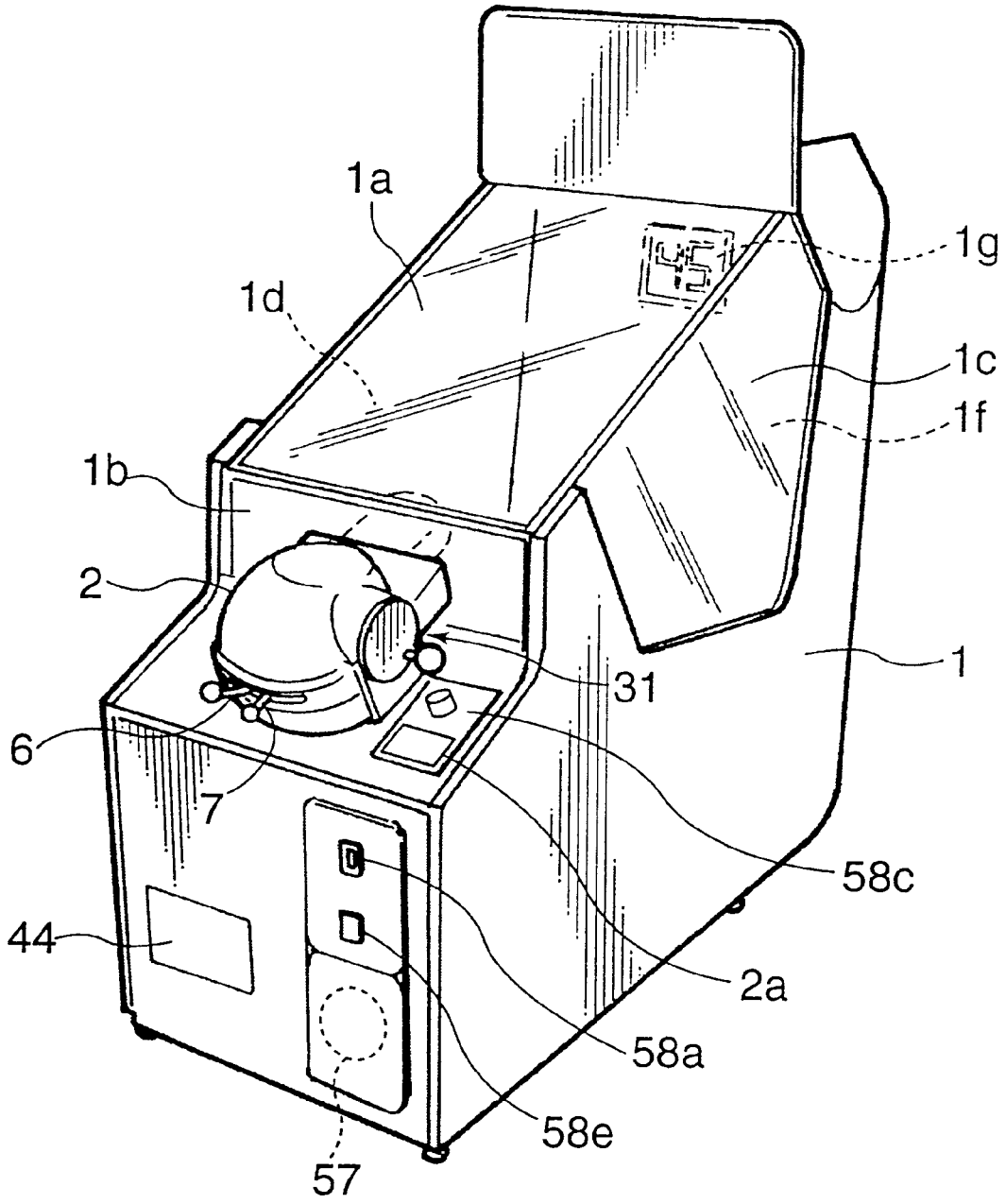
FIG. 1 is a perspective view showing an external construction of a gift game machine embodying the invention.
Figure 2:
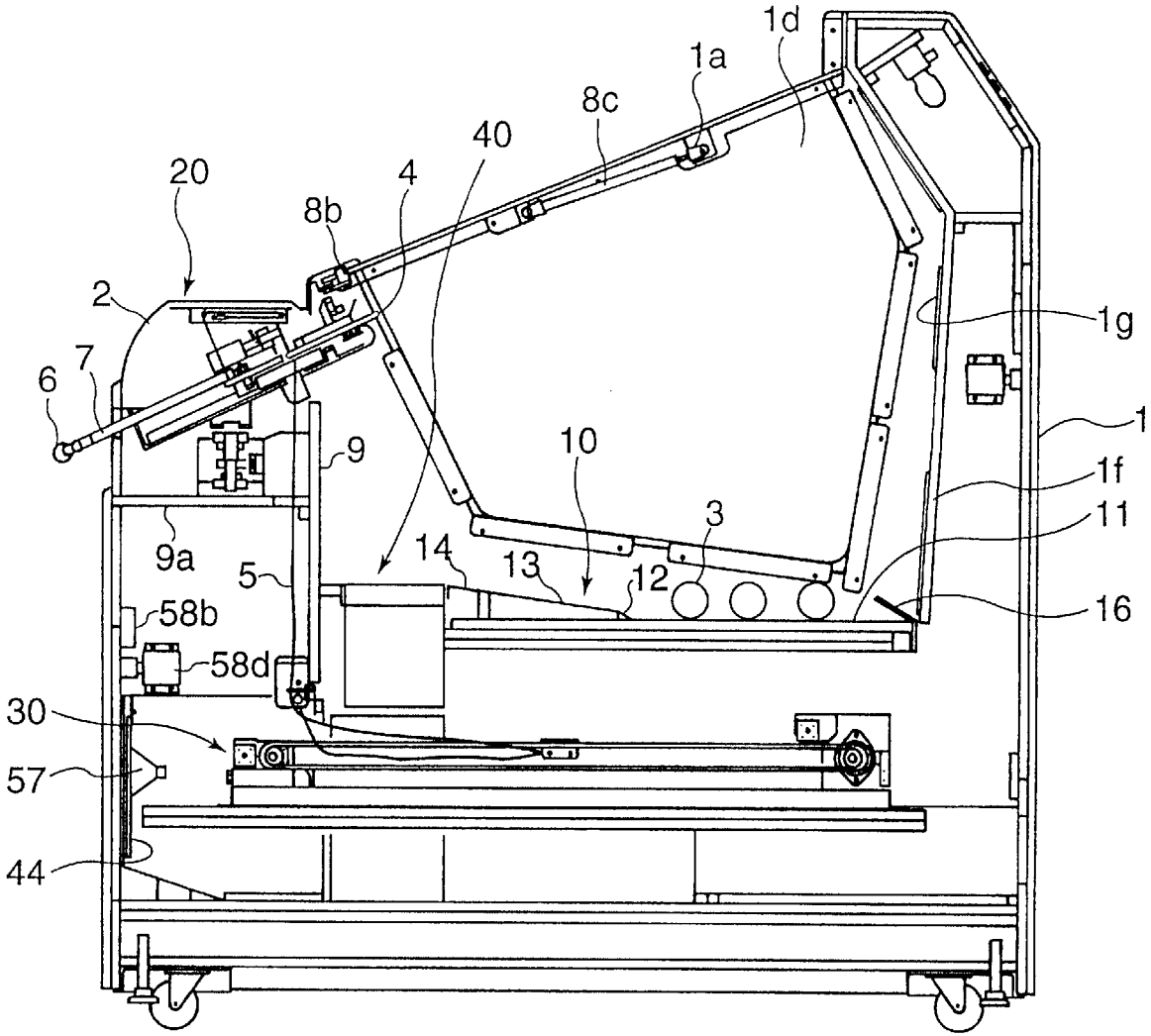
FIG. 2 is a vertical sectional view showing an internal construction of the gift game machine.

Referring to FIGS. 1 and 2, a gift game machine 1 comprises a housing 1, an operation cover 2, a support table 10 on which gift articles 3 are placed, a shooter 20 for shooting a moving object (hereinafter, referred to as "catcher") 4 in the form of a ring to catch a gift article 3, a recovery section 40 for discharging a gift article 3 caught by the catcher 4 to an outside, and a restorer 30 for restoring the catcher 4. Further, a handle 6, a shooting rod 7 and an operation handle are provided below the operation cover 2.

First, a construction of the gift game machine will be described below. The housing 1 has a top portion 1*a*, an upper front portion 1*b* behind the operation cover 2 and upper side portions 1*c* and 1*d* which are defined by transparent resin plates, and other portions which are made of opaque material. The top portion 1*a* is opened by swinging up the transparent plate about a shaft provided in a rear top after loosening screws 8*b* provided on a front top of the machine. The opened state and closed state of the transparent plate are maintained by a gas damper 8*c*. In the opened state, a desired number of gift articles 3 are placed on the support table 10. The gift articles 3 each includes a ball-shaped transparent or translucent capsule, and a pleasant thing housed in the capsule, but have different sizes from one another.

On a side of a lower front portion of the housing 1 are provided a speaker 57, a coin inlet 58*a*, a switch 58*b* to be operated by an inserted coin, and a coil blocker 58*d* for returning a coin inserted during a game operation or irregular coin to a return port 58*e*. A number display unit 1*g* having seven segments for showing two-digit numbers is provided on a rear inner surface If of the housing 1. As shown in FIG. 1, on a front table on which the operation cover 2 is mounted is provided an operation display unit 2*a* for displaying the number of game plays and a push button start switch 58*c* for starting a game.

The gift game machine has selective two modes, one being a play time variable mode, and the other being a play time fixed mode. In the play time variable mode, the number display unit 1*g* displays rapidly changing two-digit numbers to the player, the player arbitrarily stops the number change by pushing the switch 58*c* to thereby set a play time. In the play time fixed mode, the number display unit 1*g* displays a specified fixed number. In this embodiment, the displayed number is defined in the unit of second. The number is decremented as time elapses after the start switch 58*c* is turned on. The player is required to play a game within the set play time. The decrement of the set number is controlled by a controller 50 to be described later.

The support table 10 includes a horizontal portion 11, a stepped portion 12, a first slant portion 13 and a second slant portion 14. The second slant portion 14 can be adjusted to have an inclination different from that of the first slant portion 13 by a hinge 15 (see FIG. 9) attached to an end of the first slant portion 13. The second slant portion 14 is held at a desired inclination by providing a length adjustable support rod under the second slant portion 14 or using flange of the hinge 15. The horizontal portion 11 has a function of preventing ball-shaped gift articles 3 from moving to one side, and a function of dispersing ball-shaped gift articles 3 uniformly owing to a collision of gift articles already stayed on the horizontal portion 11 with a gift article returned through the way of the first and second slant portions 13 and 14, and the stepped portion 12. In this embodiment, the horizontal portion 11 is formed with an entire flat surface. Alternatively, it may be appreciated to uniformly arrange a number of dents for receiving gift articles 3.

Figure 3:
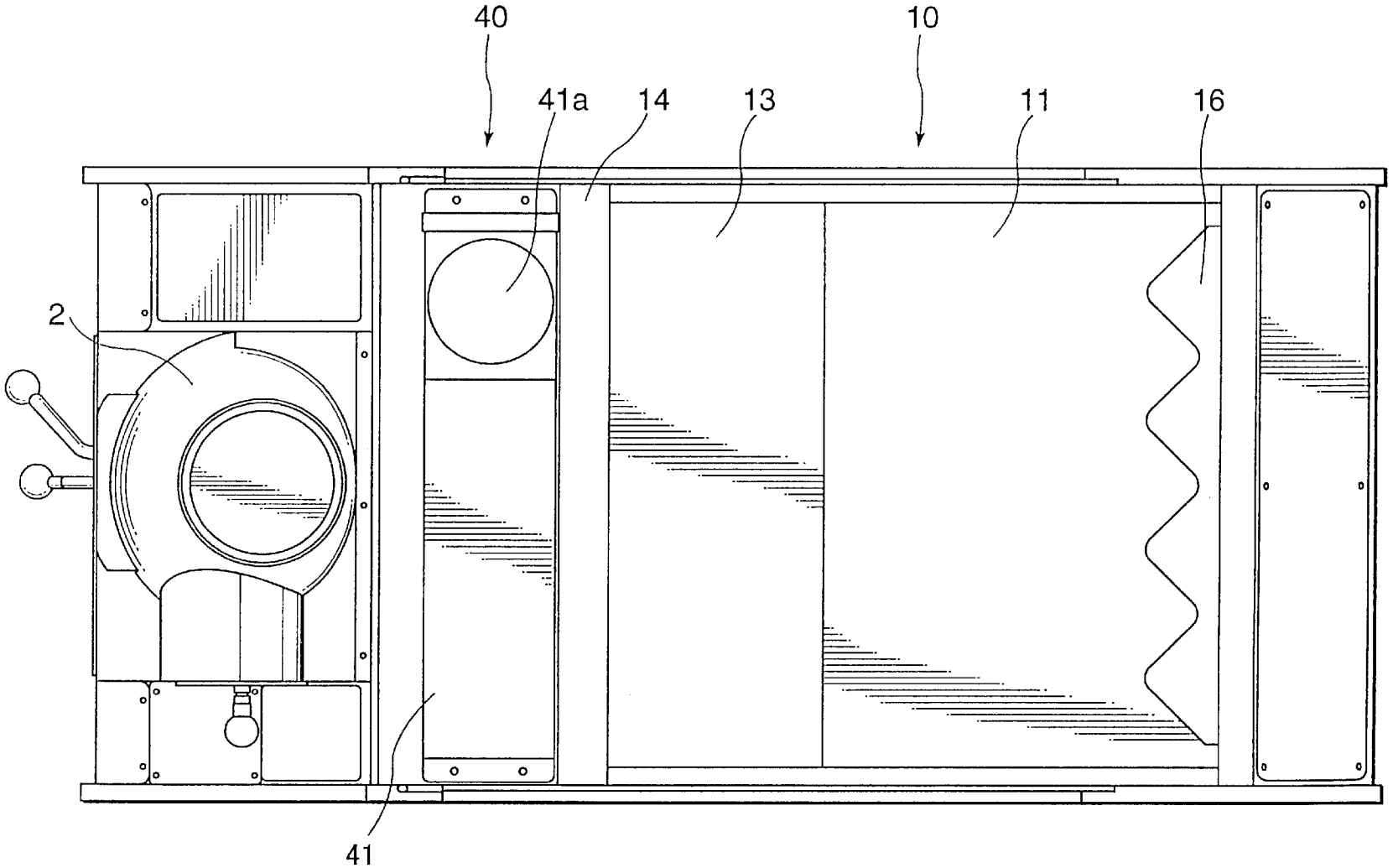
FIG. 3 is a top plan view showing an internal construction of the gift game machine.
Figure 4:
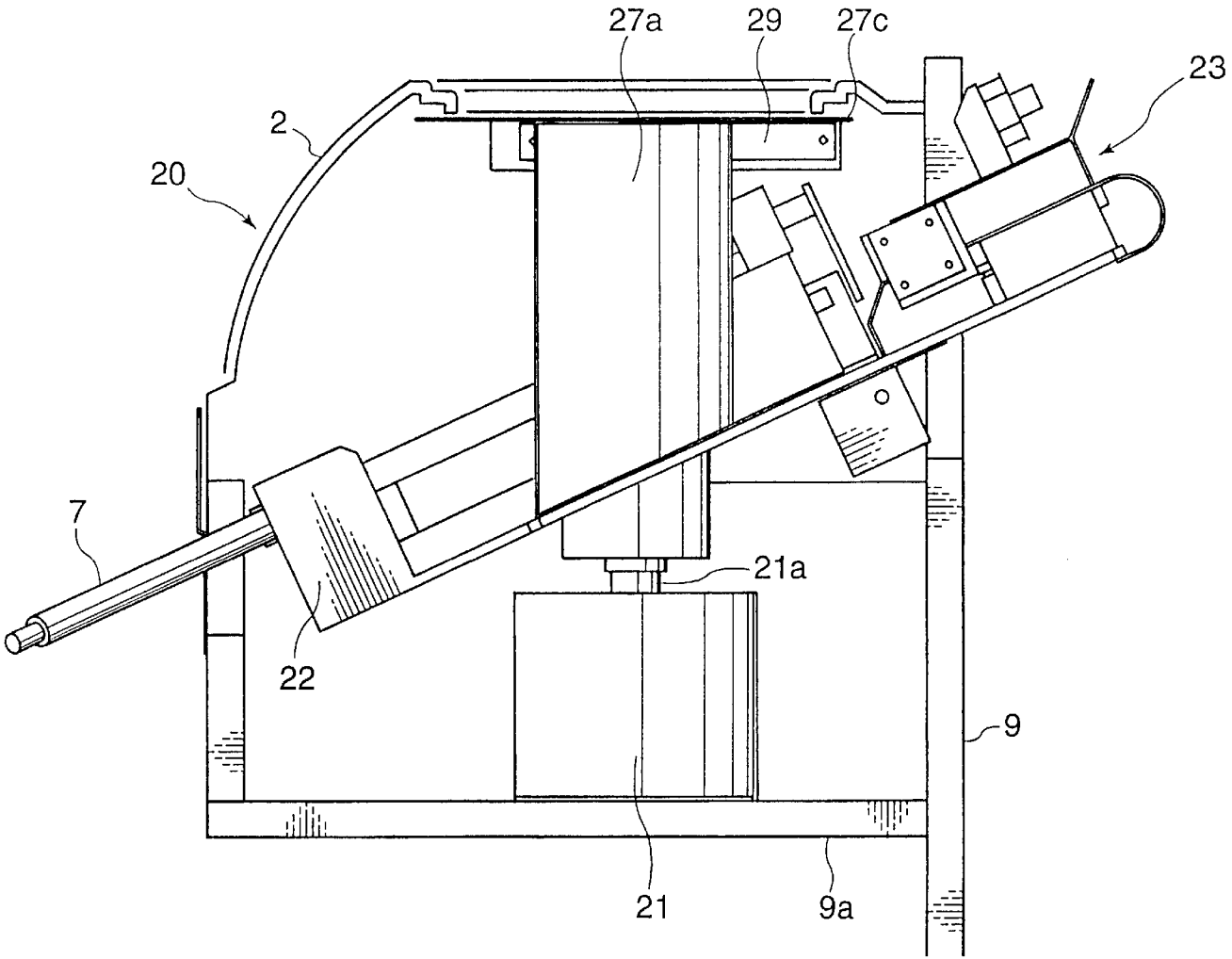
FIG. 4 is an expanded vertical sectional view showing a shooting section of the gift game machine.

Further, there is provided a gift article staggering member 16 for staggering gift articles 3 in a rear space. The gift article staggering member 16 is made of acrylic resin or the like, and the top end of the member 16 is shaped into a wave. The member 16 is inclined toward the stepped portion 12 as shown in FIGS. 2 and 3. The gift article staggering member 16 makes it easier for the moving catcher 4 to catch a gift article 3. Specifically, there is a likelihood that gift articles 3 stay in a line parallel to a rear inner surface If unless the staggering member 16 is provided, consequently making it difficult to catch a gift article 3 by the moving catcher 4. However, in the state that gift articles 3 staggeringly stay, the moving catcher 4 will catch a gift article 3 at a higher possibility. It may be appreciated to provide such gift article staggering members near the opposite both side surfaces 1*c* and 1*d*. Also, it may be appreciated to shape the top end of the staggering member into a saw-tooth or the like. Further, it may be possible to provide a plate having no staggering end near inner surfaces merely to keep gift articles to be spaced away from the inner surface.

The stepped portion 12, the first slant portion 13 and the second slant portion 14 serve as preventing gift articles 3 from moving forward.

Next, the shooter 20 will be described with reference to FIGS. 4 to 8. The shooter 20 is mounted on a horizontal support plate 9*a* of a frame structure 9 provided in the housing 1. The shooter 20 includes a bearing support block 21 having a rotary shaft 21*a*, a support frame 22 fixedly mounted on the rotary shaft 21*a*. The support frame 22 rises toward the rear of the housing 1. On the support frame 22 are provided a accommodation section 23 disposed at its rear end for accommodating the catcher 4, a hitting member 24 disposed at its front end and coupled to the shooting rod 7, and a spring 25 connected with the hitting member 24 at one end thereof, rear and front stoppers 26*a* and 26*b* for restricting the movement of the hitting member 24 within a range between a rear limit position E and a front limit position F owing to contact of the stoppers 26*a* and 26*b* with a projection 24*a* formed on a side of the hitting member 24, a shoot preparing device 28, and a pulling force detector 29. The shoot preparing device 28 is provided with a solenoid 28*a* attached to a support plate 22*b* provided above the support frame 22. The pulling force detector 29 is fixedly attached on an underside of a support plate 27 which is attached on a top of side plates 27*a* fixedly attached on both sides of the support frame 22. The support frame 22 is formed with an opening 22*c* at the position of a bottom plate thereof that is below a front end of the accommodation section 23. The opening is adapted for restricting or guiding the connecting cord 5 to a cord regulator 35 to be described below.

The shooting rod 7 is movable in the range between the rear and front limit positions E and F. The shooting rod 7 is pulled in the forward direction (i.e., the projection 24*a* of the hitting member 24 approaching to the front stopper 26*b*) while gripping a knob 7*a*. The further the shooting rod 7 is pulled, the greater the resilient force of the spring 25 is. The pulling force of the shooting rod 7 (i.e., the resilient force of the spring 25) is detected by the pulling force detector 29. Upon the shooting rod 7 being released, the hitting member 24 connected with the shooting rod 7 swiftly returns or runs rearward to thereby hit the catcher 4.

Figure 5B:
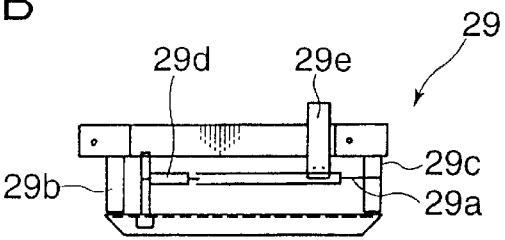
FIG. 5B is a top view of a pulling force detector for the shooter.
Figure 5A:
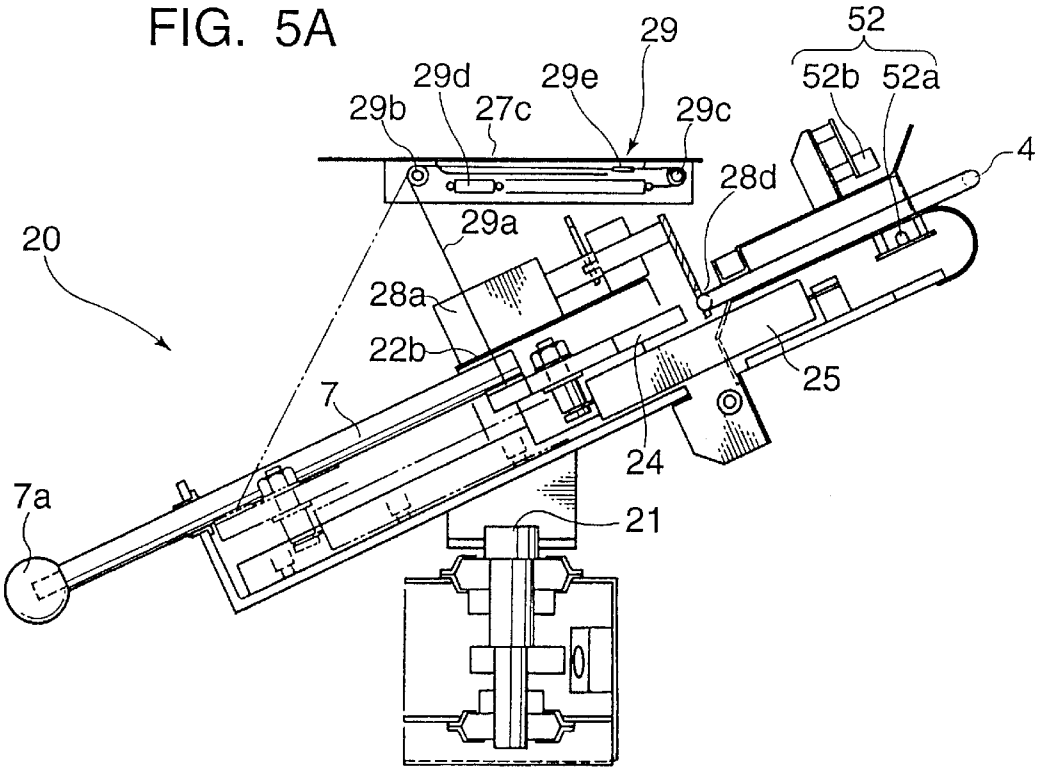
FIG. 5A is a vertical sectional view showing an internal construction of a shooter provided in the gift game machine.

As shown in FIG. 5A, the pulling force detector 29 includes a spring 29*d* mounted on the support plate 27*c*, a string 29*a* having one end connected with the hitting member 24 and the other end connected with the spring 29*d*, two rollers 29*b* and 29*c* provided for guiding the string 29*a*, a sliding member 29*e* attached to an appropriate portion of the string 29*a* and slidable in the support plate 27*c* together with the movement of the string 29*a*, an electric resistor provided along the moving range of the sliding member 29*e*, and a wiper connected with the sliding member 29*e* and operable to come into contact with the resistor. The resistor and the wiper constitute a rectilinear sliding potentiometer. The rectilinear sliding potentiometer detects a moved distance of the sliding member 29*e* based on a change in resistance of a detecting circuit. A detected distance shows a pulling force of the spring 25 acting on the hitting member 24.

The shoot preparing device 28 includes the solenoid 28*a*. The solenoid 28*a* is provided with a taking member 28*c* by the way of an extension rod 28*b*. The extension rod 28*b* is moved up and down to take the catcher 4 by the taking member 28*c* to a shooting position B from a waiting position A The extension rod 28*b* expands to place the taking member 28*c* in the waiting position A, and contracts to place the taking member 28*c* in the shooting position B.

The taking member 28*c* is formed with a recess 28*d* formed in an intermediate portion of a lower end thereof. The catcher 4 is taken by the taking member 28*c* by allowing the catcher 4 to come into the recess 28*d*, and moved to the shooting position B by the contraction of the solenoid 28*a*. In this state, the shooting rod 7 is pulled and then released, and the hitting member 24 swiftly moves rearward by the spring 25, consequently hitting the catcher 4 at a tip 24*b*.

Figure 7:
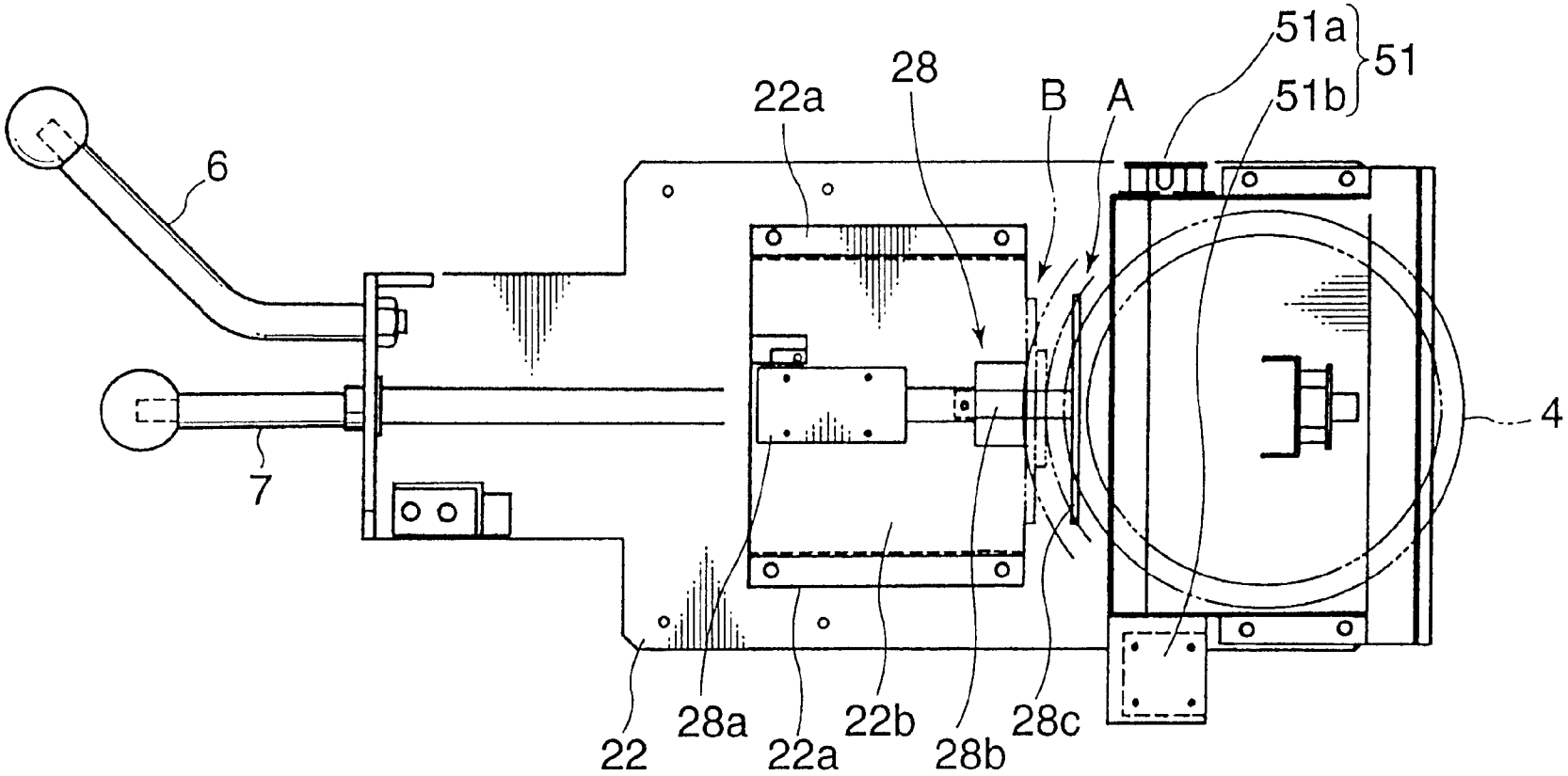
FIG. 7 is a top plan view of the shooter mounted with a solenoid.

Whether the catcher 4 is accommodated in the accommodation section 23 is detected by a transmission type optical sensor 51 provided with a light emitter 51*a* and a light receiver 51*b* horizontally in the accommodation section 23 (see FIG. 7). Whether the catcher 4 is shot from the accommodation section 23 is detected by a translucent optical sensor 52 provided with a light emitter 52*a* and a light receiver 52*b* vertically in the accommodation section 23 (see FIG. 5). The catcher 4 intercepts light sent from the light emitter 51*a*, thereby pursuing these detecting operations. The optical sensor 52 is arranged in a position close to a rear end of the accommodation section 23. This arrangement is made to ensure re-shooting of the catcher after shooting failure. Specifically, the optical sensor 52 is made not to detect the catcher 4 when the catcher 4 is not shot well and jumps out of the accommodation section 23, thereby permitting the catcher 4 to be returned into the shooting position B and to be shot by the hitting member 24 again. As the optical sensors 51 and 52, a reflection type sensor may be used. In place of the optical sensors 51 and 52, it may be possible to make the catcher 4 by magnetic material, and use a magnetic sensor for detecting the catcher 4 based on magnetism. Furthermore, it may be possible to use a mechanical switch for detecting presence of the catcher 4 based on contact.

Figure 6:
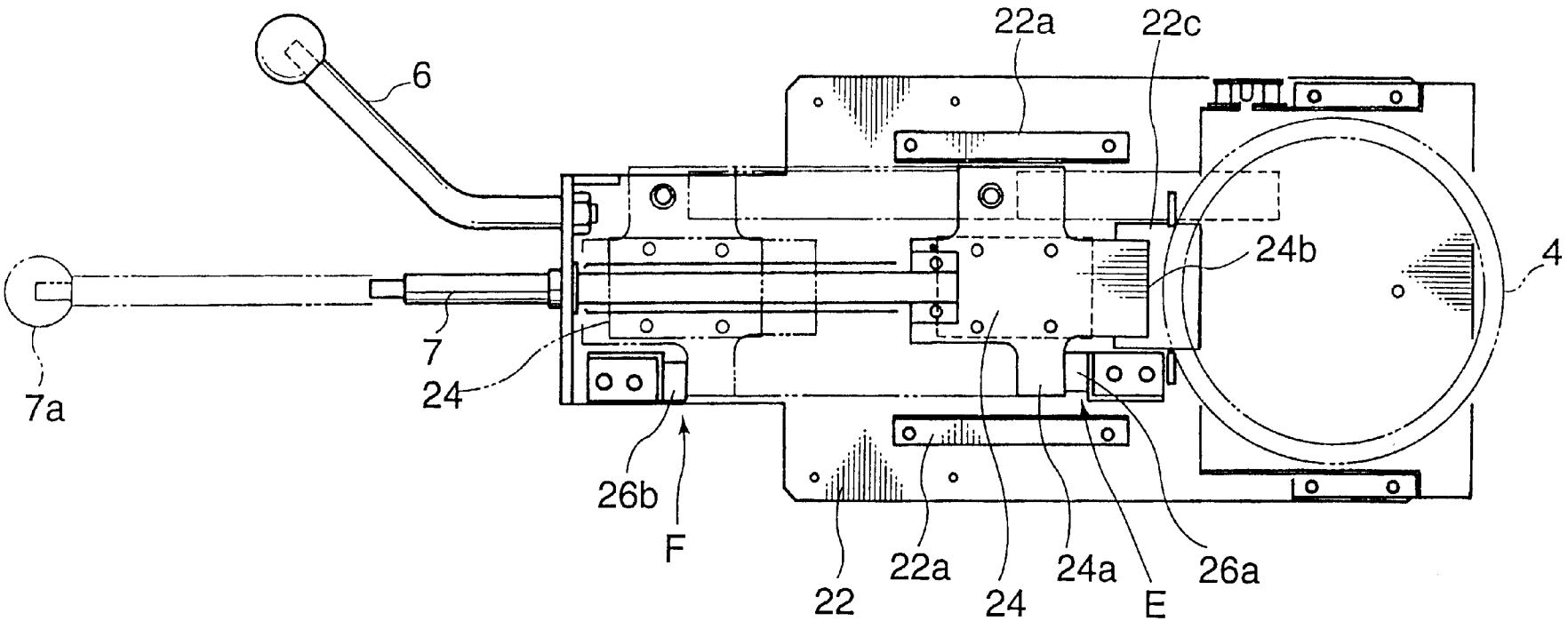
FIG. 6 is a top plan view of the shooter.
Figure 8:
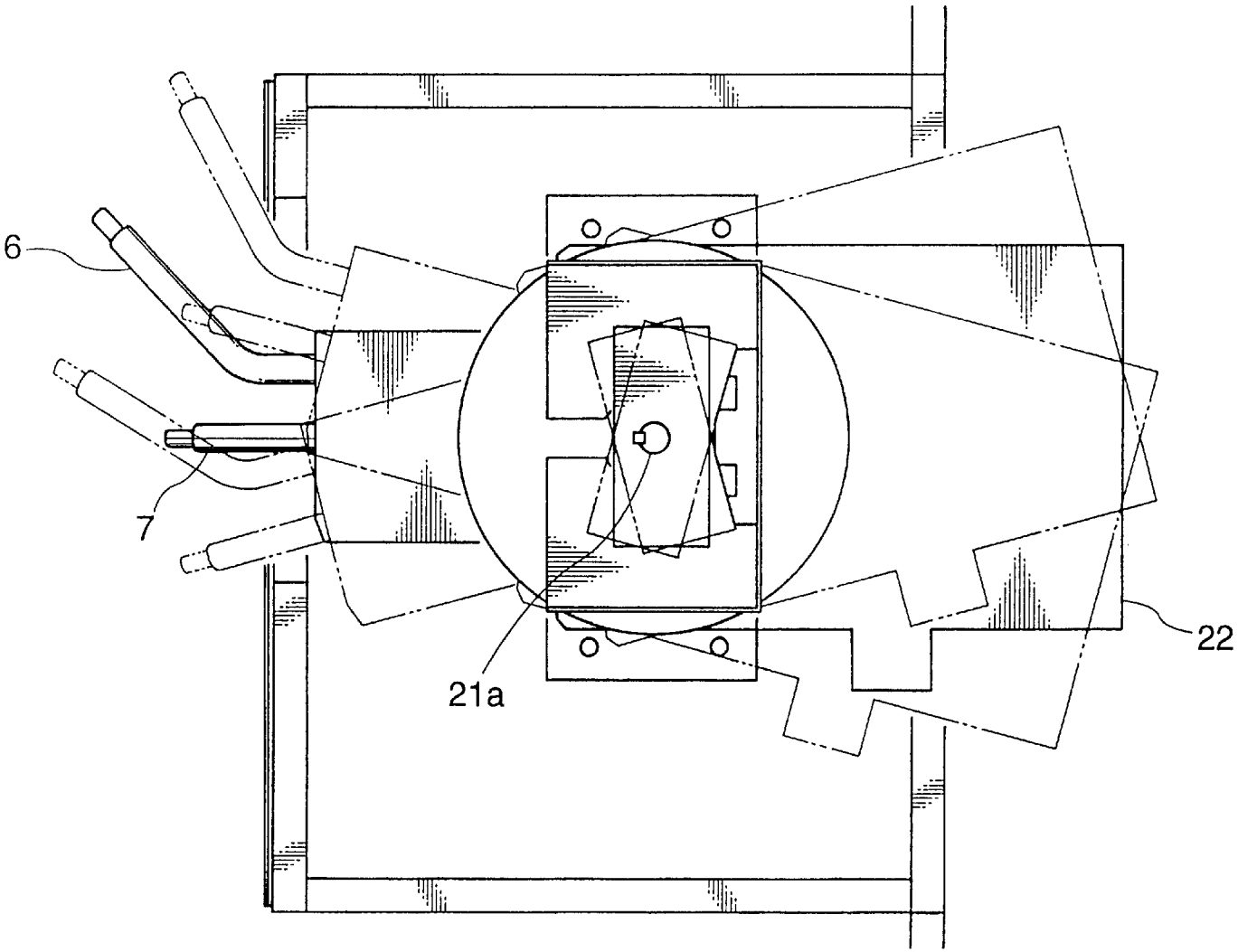
FIG. 8 is a diagram showing a pivotal movement of the shooter.

Further, the support frame 22 is mounted with a handle 6 for adjusting the shooting direction of the catcher 4 as shown in FIG. 6. The support frame 22 is turned about the rotary shaft 21*a* of the bearing support block 21 by gripping the handle 6 as shown in FIG. 8.

The recovery section 40 serves to recover a gift article 3 caught by the catcher 4 to the outside, and includes a chute 41 connected to the second slant portion 14 of the support table 10, a passage 42 provided under the chute 41, a take-out chamber 43 connected with the passage 42, and an openable cover 44 in the front of the game machine. The cover 44 is pivotally supported by a hinge 44*a* provided at an upper position, and is openable inward. Indicated at 45 is a stopper for restricting the movement of the cover 44.

Figure 9:
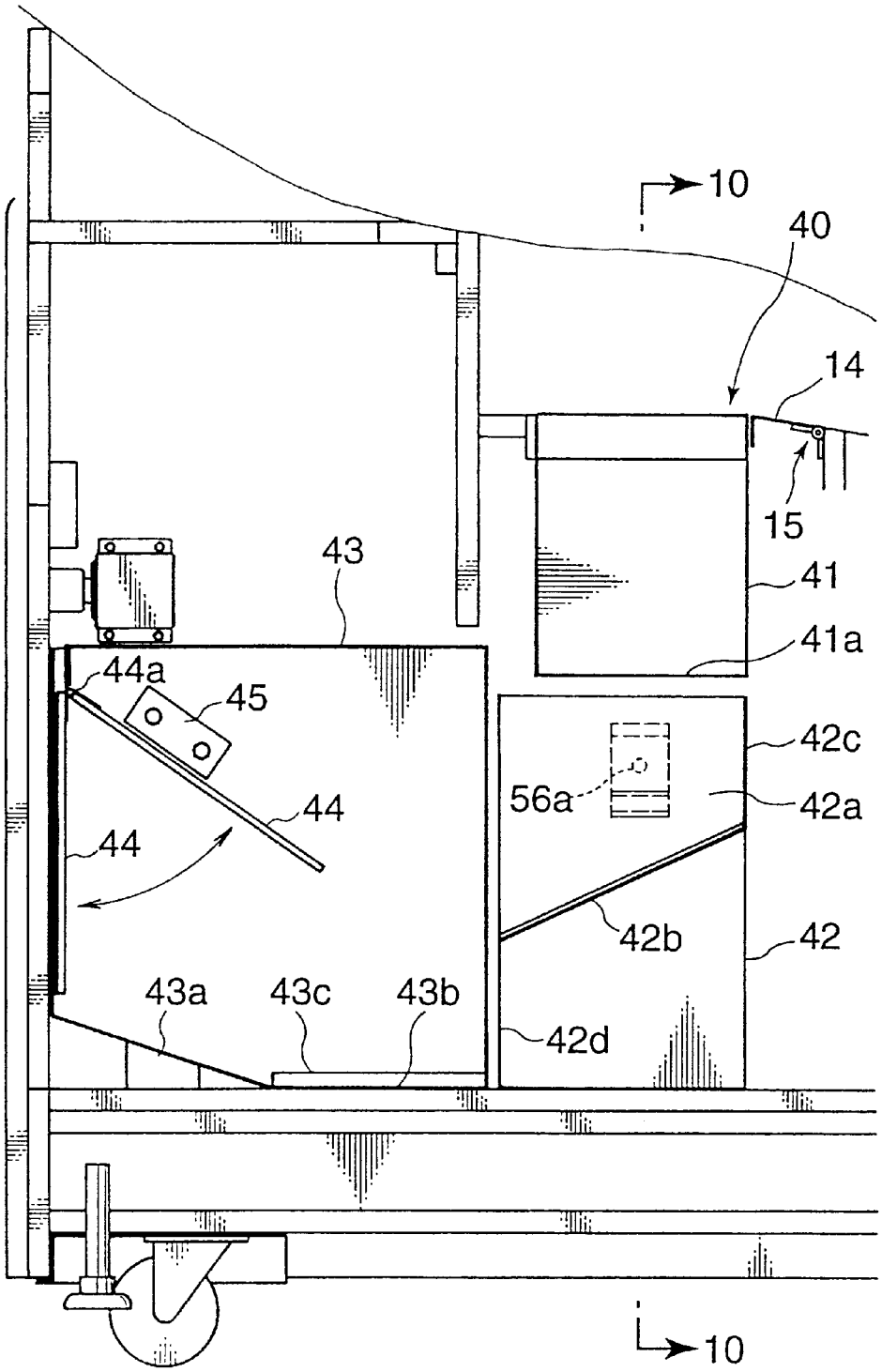
FIG. 9 is an expanded vertical sectional view showing a recovery section of the game machine.
Figure 10:
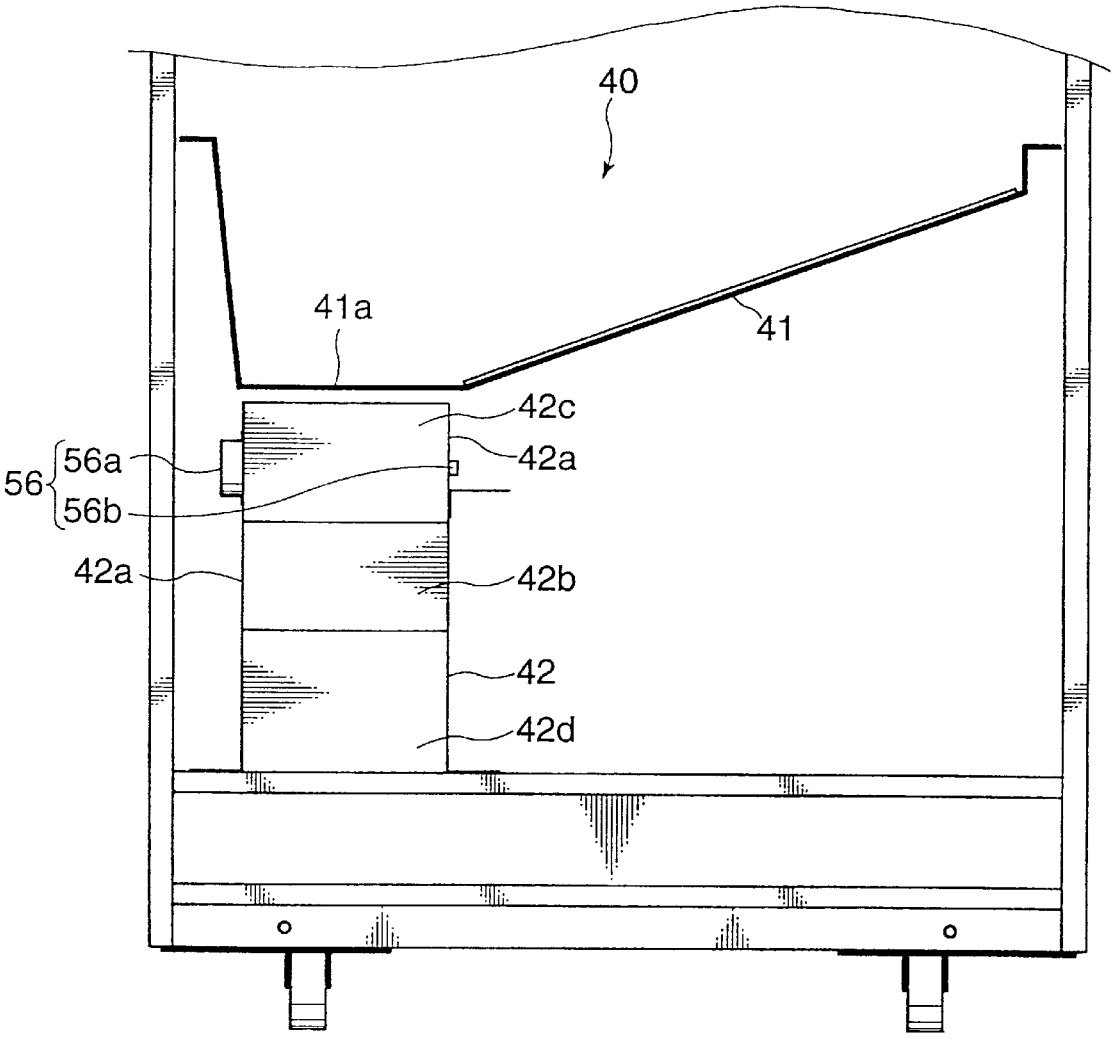
FIG. 10 is a sectional view taken along the line 10—10 in FIG. 9.
Figure 11:
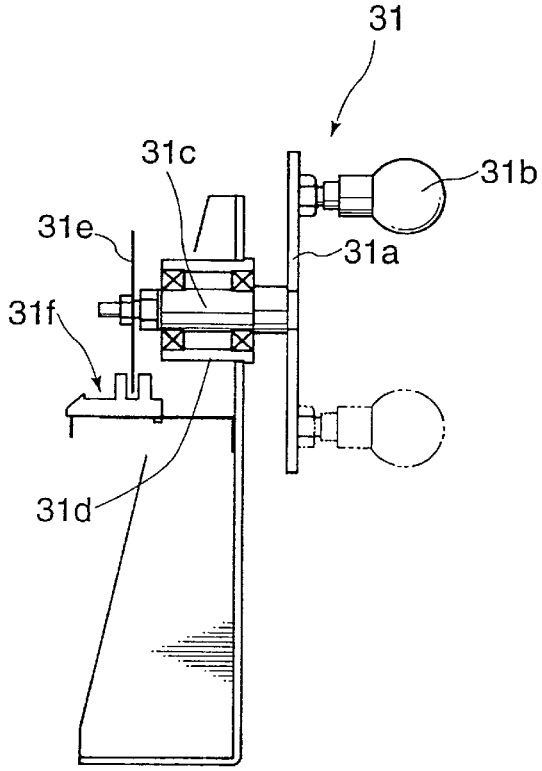
FIG. 11 is a partially sectional view showing an internal construction of a player actuating section in a moving object restorer provided in the gift game machine.
Figure 12:
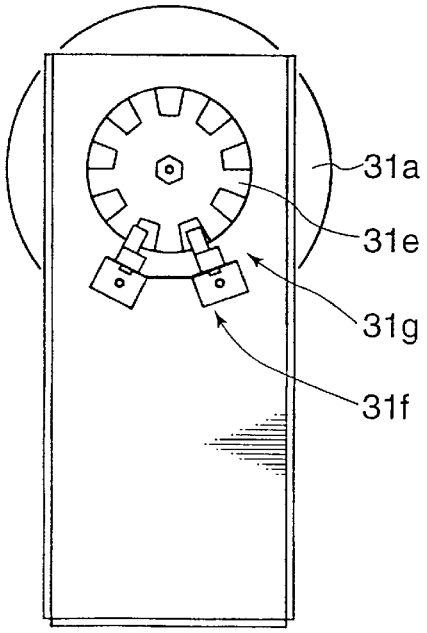
FIG. 12 is a side view of the operation handle.

The chute 41 is formed to have the shape of a gutter having a sharp inclination in a front portion and a gentle inclination in a rear portion as shown in FIG. 10. An opening 41*a* is formed in a lower portion of the chute 41. The passage 42 is provided an inclined plate 42*b* in an intermediate position. The inclined plate 42*b* is held by both side plates 42*a* and 42*a*. The inclined plate 42*b* falls in the forward direction as shown in FIG. 9. There are provided a rear plate 42*c* for preventing a gift article 3 from dropping rearward, and a front plate 42*d* for preventing a gift article 3 from entering the underside of the inclined plate 42*b*. Above the inclined portion 42b in the passage 42 is provided a translucent optical sensor 56 having a light emitter 56*a* and a light receiver 56*b* on the two side plates 42*a* opposed to each other. The optical sensor 56 is provided with a light emitter 56*a* facing a space in which a gift article 3 falls. The optical sensor 56 detects a gift article 3 by interception of the gift article 3 light sent from the light emitter 56*a*. A reflection type sensor may be used in place of the translucent optical sensor 56. In place of the optical sensor 56, further, it may be possible to use a magnetic sensor or a mechanical switch.

The take-out chamber 43 has a slant portion 43*a* in front, and a flat portion 43*b* in rear. There is provided on the flat portion 43*b* a cushion member 43*b* for keeping a dropped gift article 3 from receiving a serious impact. The slant portion 43*a* allows gift articles 3 to roll to the cushion member 43*b*, thereby preventing a gift article 3 from being struck by the inward openable cover 44.

Next, description will be given to the restorer 20 for restoring the catcher 4. The restorer 30 includes an operation handle 31 disposed in the operation cover, a motor 32 to be controlled in response to the operation handle 31, an endless chain 33 to be driven by the motor 32, a cord regulator 35 for controlling the connecting cord 5, and a cord guiding unit 36 mounted on the frame structure 9 for guiding the connecting cord 5.

The operation handle 31 includes a rotary wheel 31*a* rotatable about a horizontal axis, a knob 31*b* attached on the rotary wheel 31*a*, a rotary shaft 31*c* extending along the horizontal axis and coupled to a center of the rotary wheel 31*a*, a bearing 31*d* for rotatably supporting the rotary shaft 31*c*, a rotary disk 31*e* attached to the other end of the rotary shaft 31*c*, and a detector 31*f* for detecting rotation of the rotary disk 31*e*. The rotary disk 31*e* and the detector 31*f* constitute a rotary encoder 31*g*. When the wheel 31*a* is rotated in a given direction, the rotary disk 31*e* rotates and the detector 31*f* outputs a rotation pulse signal proportional to the rotation of the rotary disk 31*e*.

Figure 13:
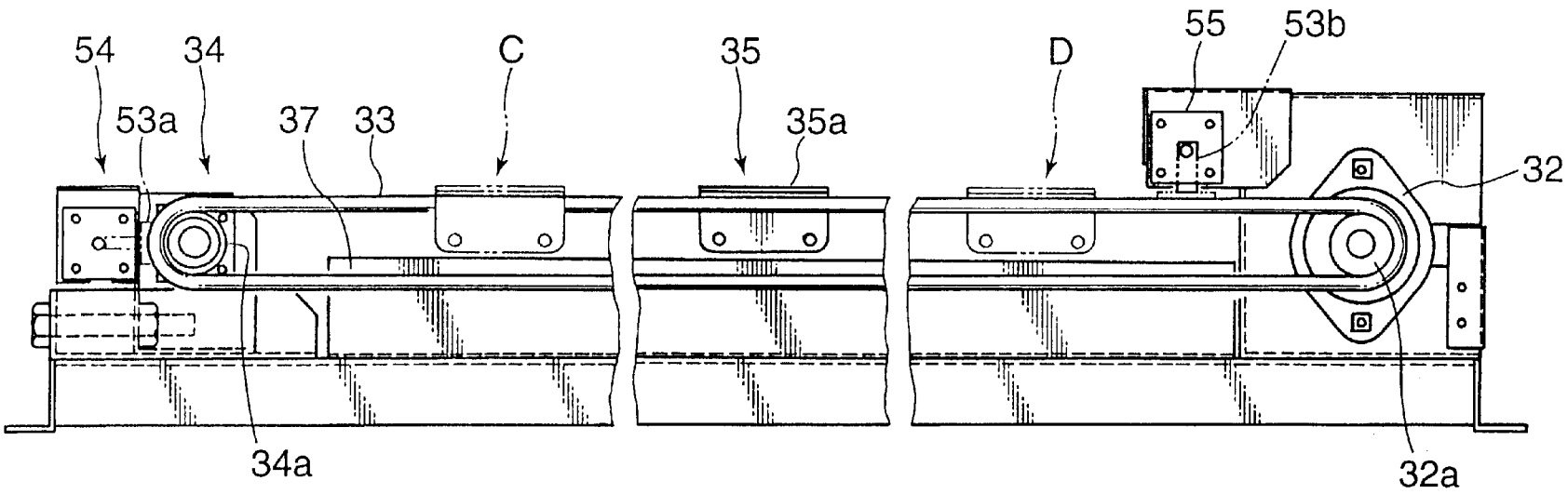
FIG. 13 is an expanded side view showing a connecting cord regulation section of the moving object restore.
Figure 14:
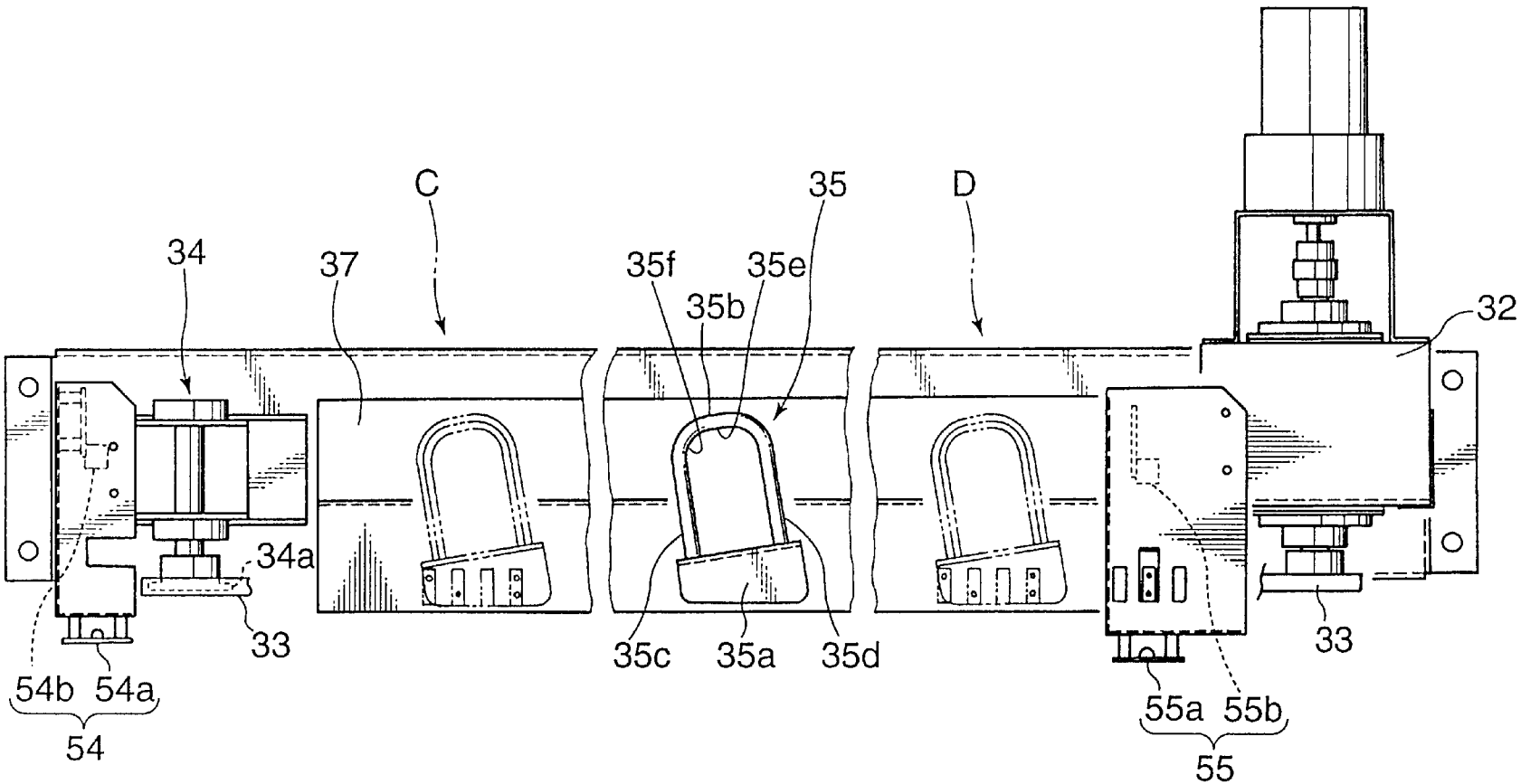
FIG. 14 is a top plan view showing the connecting cord regulation section.
Figure 15:
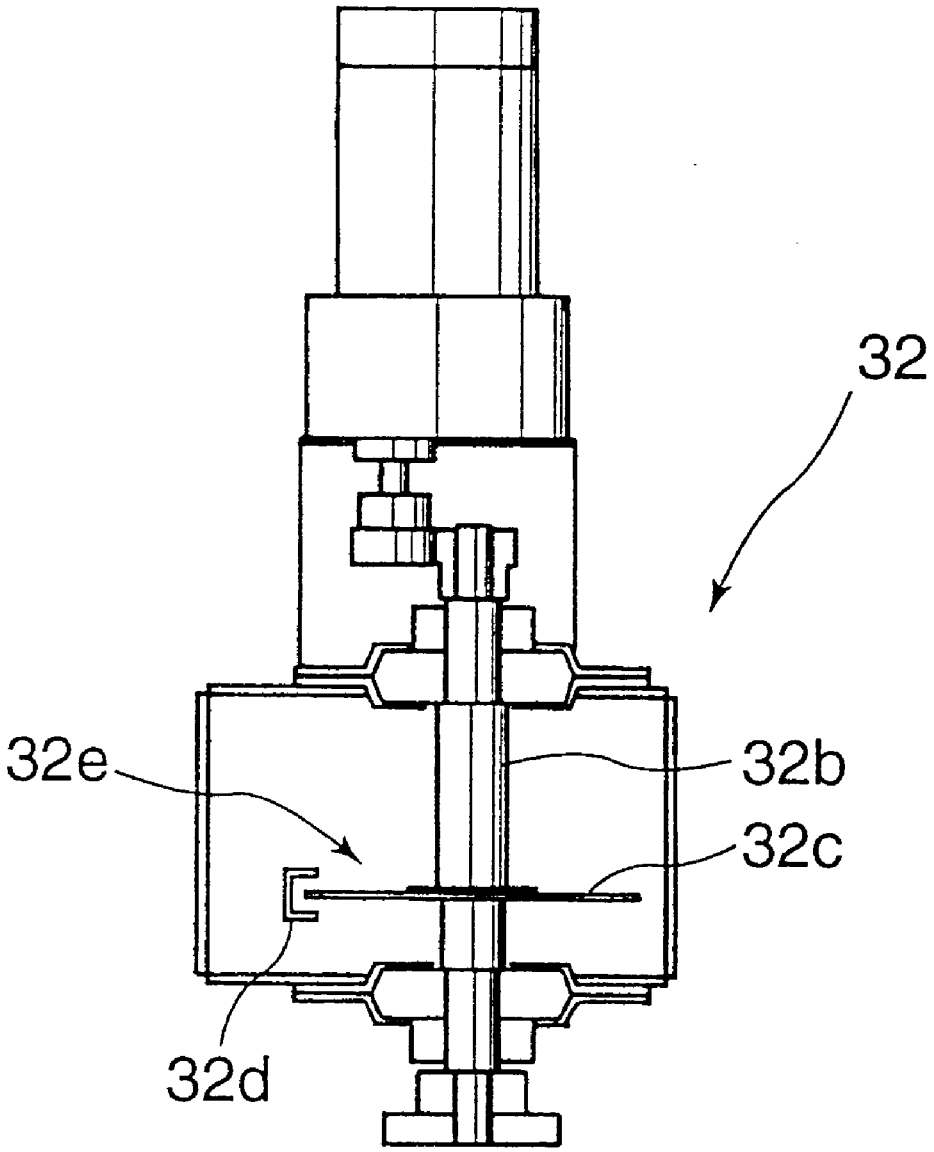
FIG. 15 is a partially sectional view showing an internal construction of a driving portion of the connecting cord regulation section.

As shown in FIGS. 13 and 14, the chain 33 is wound over a sprocket 32*a* attached to the drive shaft of the motor 32 provided in a rear portion of the housing 1 and a sprocket 34*a* attached to a driven shaft 34 provided in a front portion of the housing 1. The cord regulator 35 includes a base member 35*a* fixedly attached to the chain 33 and a U-shaped hook 35*b* fixedly attached to the base member 35*a*. The hook 35*b* has straight portions 35*c* and 35*d* and a curved portion 35*e*. The hook 35*b* is entirely inclined in the front direction.

As shown in FIG. 10, the motor 32 is provided with a rotary encoder 32*e* including a rotary disk 32*c* fixedly attached on the rotary shaft 32*b* of the motor 32 and a detector 32*d*. The control of the motor 32 is carried out based on pulses detected by the rotary encoder 31*g* and pulses detected by the rotary encoder 32*e* on the motor 32 such that a controller including a CPU to be described below causes the latter to be coincident with or to correspond to the former. The motor 32 is a DC motor, for example, and is duty controlled.

Figure 16:
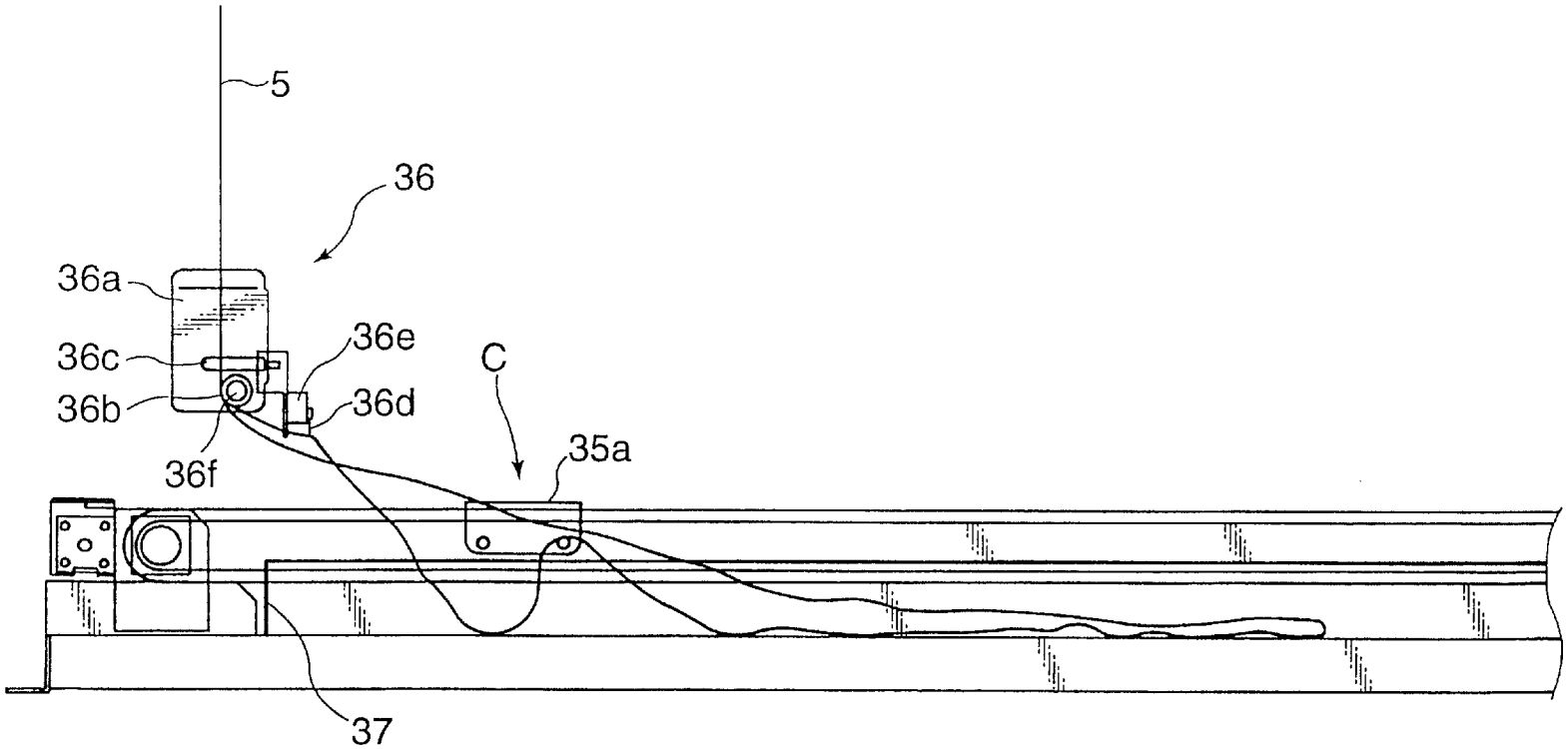
FIG. 16 is a side diagram showing a cord loosened state of the cord regulation section.
Figure 17:
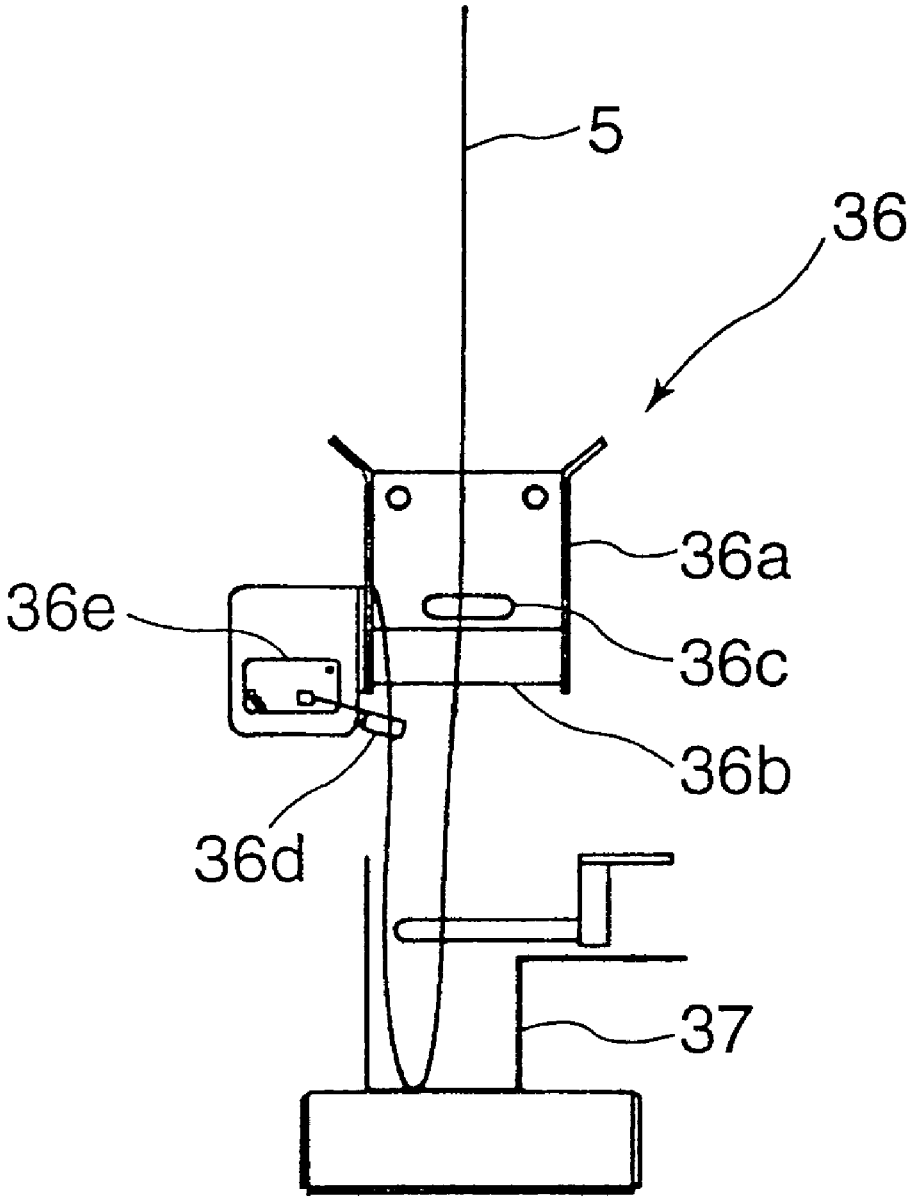
FIG. 17 is a front diagram showing the cord loosened state.
Figure 18:
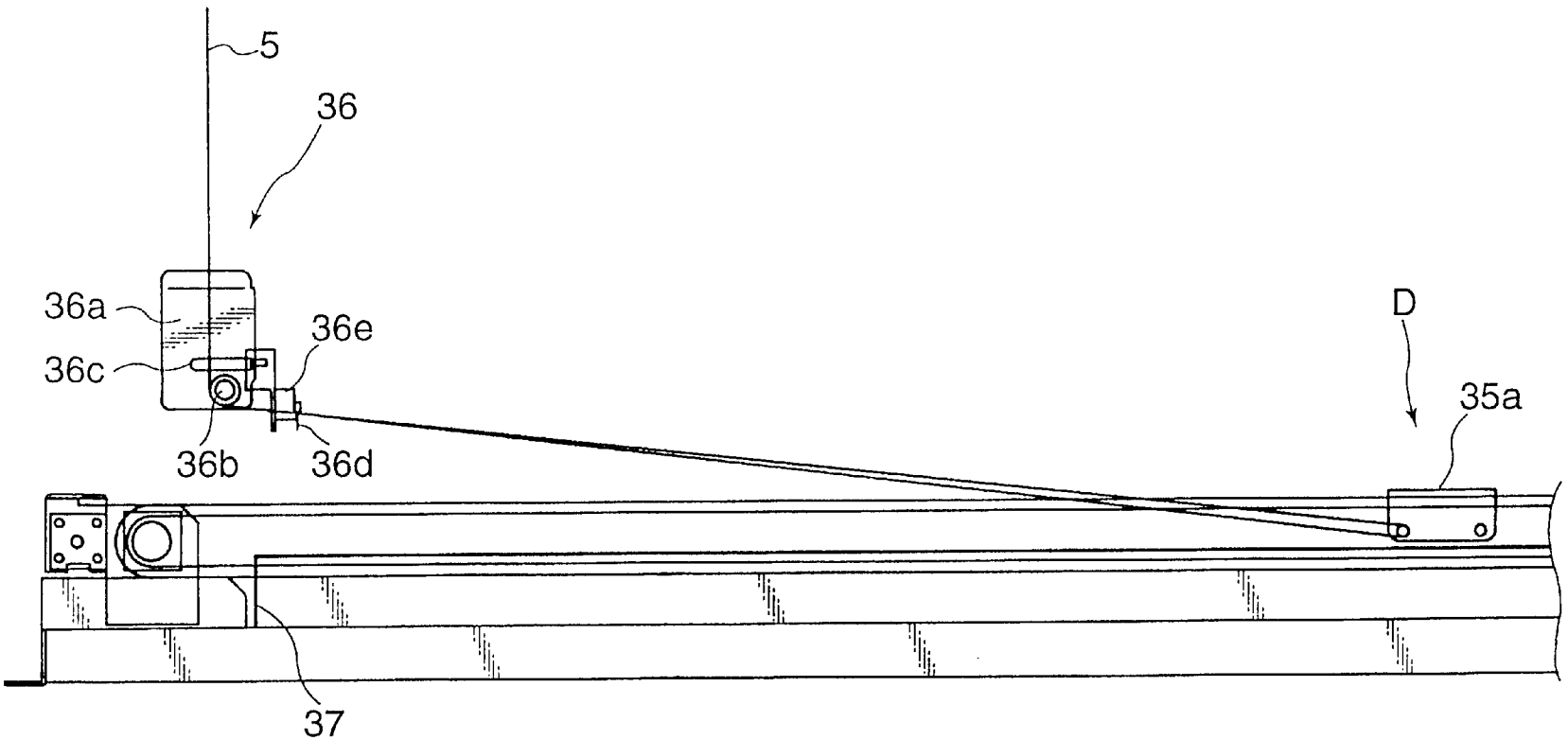
FIG. 18 is a side diagram showing a cord tightened state of the cord regulation section.
Figure 19:
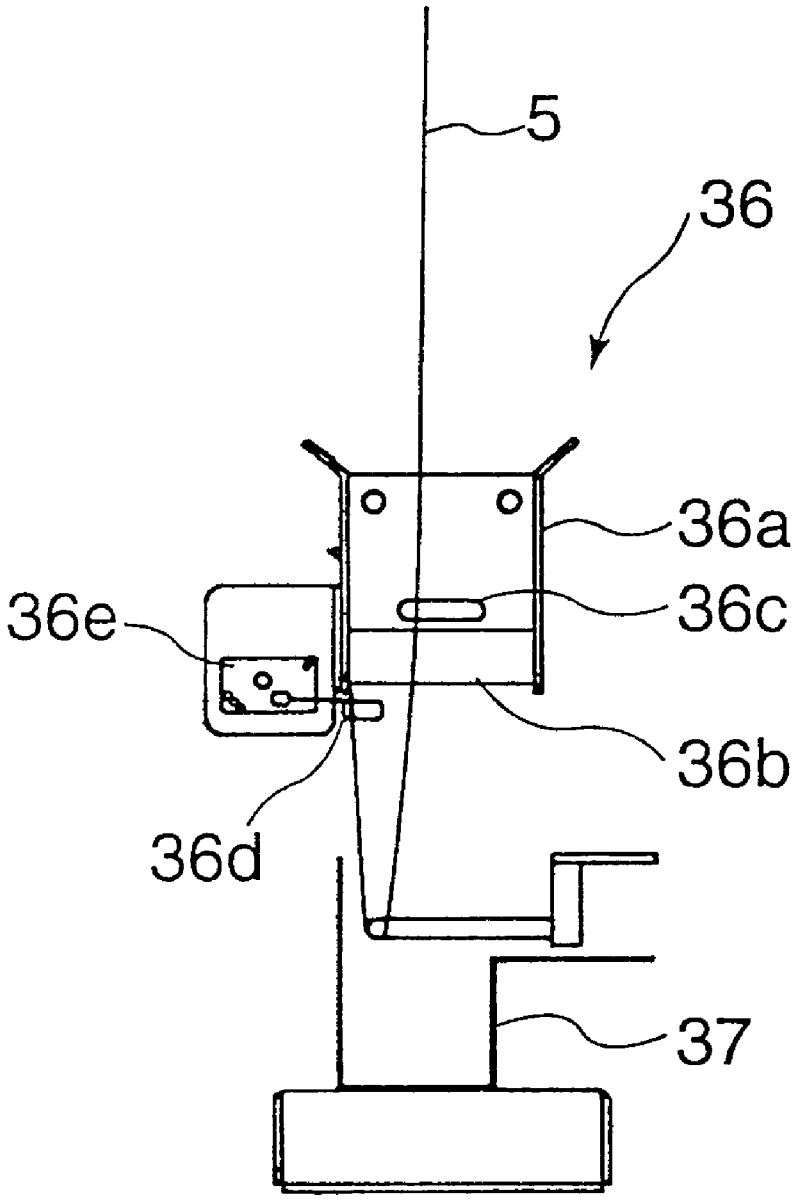
FIG. 19 is a front diagram showing the cord tightened state.

The cord regulator 35 pulls or loosens the connecting cord 5 by a reciprocating movement. Specifically, one end of the connecting cord 5 is connected with the catcher 4 and the other end is connected with a fixed support shaft 36*f* provided in the cord guiding unit 36 as shown in FIG. 2, while passing the U-shaped hook 35*b* of the cord regulator 35 as shown in FIGS. 16 to 19. The cord guiding unit 36 is positioned more outside than the catcher 4. The connecting cord 5 is passed through the hook 35*b* in such a way as not to wind or circle the hook 35*b*. In other words, the part of the connecting cord 5 extending toward the fixed support shaft 36*f* passes outside of the hook 35*b* while the part of the connecting cord 5 extending toward the catcher 4 passes inside of the hook 35*b*. FIGS. 16 and 17 show a loosened state of the connecting cord 5 while FIGS. 18 and 19 show a tightened state of the connecting cord 5.

When the cord regulator 35 is moved in accordance with a movement of the chain 33 driven by the motor 32 in a rearward direction, the connecting cord 5 is pulled or tightened. The cord regulator 35 is inclined forward, the connecting cord 5 is pulled at a boundary portion 35*f* between the curved portion 35*e* and the straight portion 35*c*. When the cord regulator 35 is moved in a forward direction, the connecting cord 5 is loosened. There is provided a tangling preventor conveniently in the form, for example, of a cord guide channel 37 under the space for the movement of the cord regulator 35. The loosened portion of the connecting cord 5 is held in the space of the guide channel 37 while the cord regulator 35 is moved in the rearward or forward direction, thereby preventing the connecting cord 5 from tangling. In this embodiment, the cord guide channel 37 has the section having an U-shape. However, it may be possible to use a channel having a semicircular shape, V-shape, a trapezoidal shape having a longer bottom. Moreover, it may be sufficient that the cord guide channel 37 has a width to guide the loosening cord into the channel 37.

The movement of the cord regulator 35 is controlled based on detection of the optical sensor 54 or 55 detecting as to whether interceptors 53*a* or 53*b* fixedly attached onto the chain 33 intercepts the optical sensor 54 or 55 as shown in FIGS. 13 and 14. The sensor 54 has a light emitter 54*a* and a light receiver 54*b* which is to be intercepted by the interceptor 53*a*, thereby detecting a front stop position C where the connecting cord 5 is loosened. The sensor 55 has a light emitter 55*a* and a light receiver 55*b* which is to be intercepted by the interceptor 53*b*, thereby detecting a rear stop position D where the restoring cord is tightened. The optical sensors 54 and 55 are provided to prevent the connecting cord 5 from being broken off by stopping the movement of the chain 33 even if the rotary encoder 31*g* requires an excessive movement of the chain 33. As the optical sensors 54 and 55, it may be possible to use a reflection type sensor, a magnetic sensor, or a mechanical switch.

The cord guiding unit 36 includes a base member 36*a* fixedly attached to the frame structure 9, a rotary guiding sleeve 36*b* rotatably mounted on a fixed support shaft 36*f* attached to the base member, an U-shaped guide member 36*c* through which the connecting cord 5 is passed. The cord guiding unit 36 is provided with a tension sensor 36*e* having a movable member 36*d* through which the connecting cord 5 is passed. The rotary guiding sleeve 36*b* guides the connecting cord 5 from the catcher 4 to the cord regulator 35. The extreme end of the connecting cord 5 is fastened on the fixed support shaft 36*f*.

The movable member 36*d* has the form of a ring through which the connecting cord 5 is passed. In the state in which the connecting cord 5 is loosened as shown in FIGS. 16 and 17, the movable member 36*d* inclines slightly downward. In this state, the tension sensor 36*e* detects no tension of the connecting cord 5. As the tension sensor 36*e*, a micro switch or the like is used. In the state in which the connecting cord 5 is tightened as shown in FIGS. 18 and 19, the movable member 36*d* is in a horizontal direction. The tension sensor 36*e* detects a tension of the connecting cord 5. The detection is sent to the controller 50 which judges in turn that the catcher 4 is accommodated in the accommodation section 23.

Figure 20:
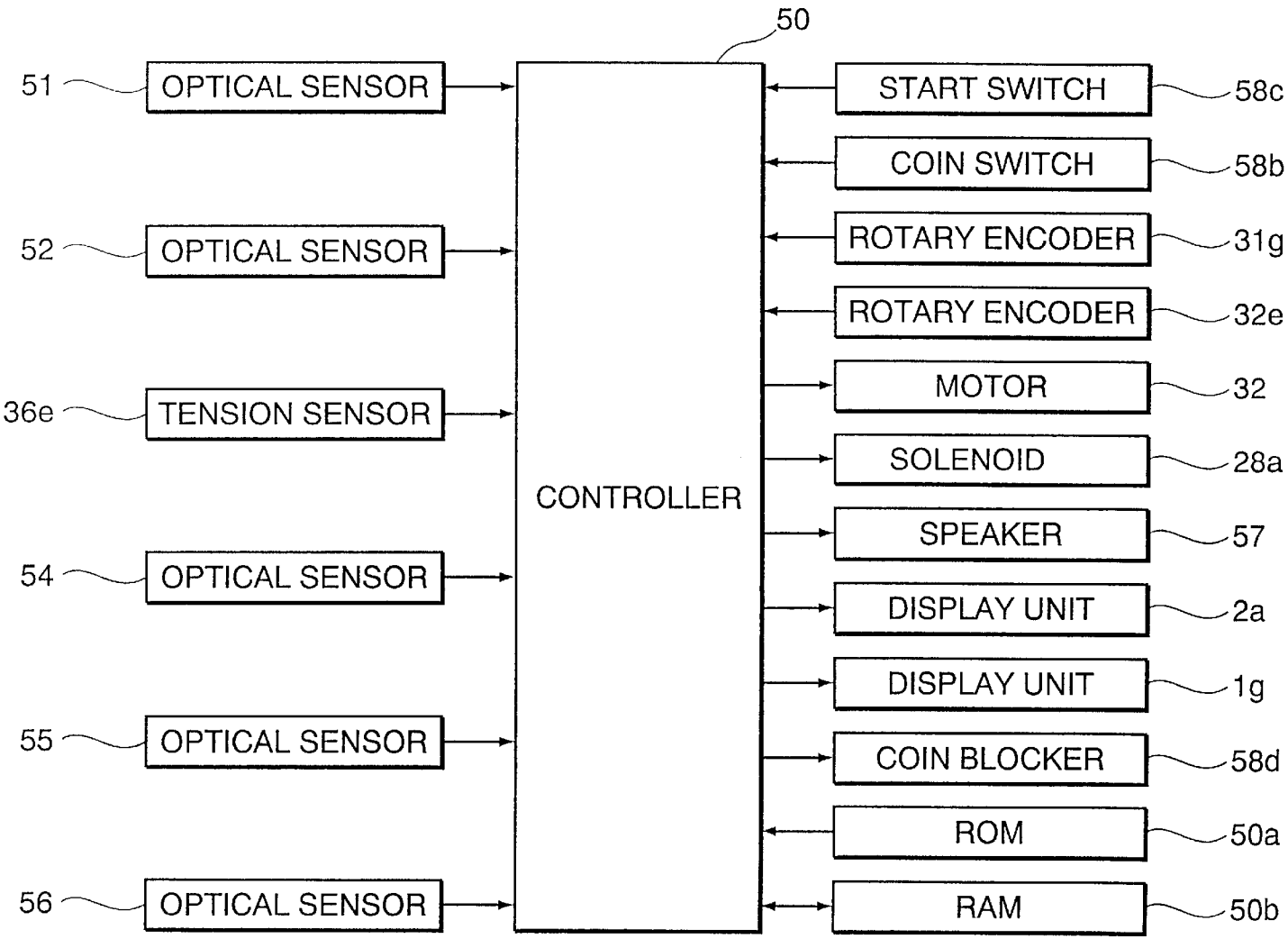
FIG. 20 is a block diagram showing a construction of a controlling system of the gift game machine.

FIG. 20 is a block diagram showing a control construction of the gift game machine. The gift game machine has the controller 50 including a CPU, a ROM 50*a* in which a control program for each operation is stored, and a RAM 50*b* for temporarily storing data for an operation. In response to a signal sent from the optical sensor 51, the optical sensor 52, the optical sensor 56, the start switch 58*c*, the coin switch 58*b* and the rotary encoder 31*g*, a signal sent from the tension sensor 36*e*, the optical sensor 54, the optical sensor 55, and the rotary encoder 32*e*, the controller 50 controls the solenoid 28*a*, the speaker 57, the operation display unit 2*a*, the number display unit 1*g*, the coin blocker 58*d*, and the motor 32. The controller 50 includes the timer as described above.

Figure 21:
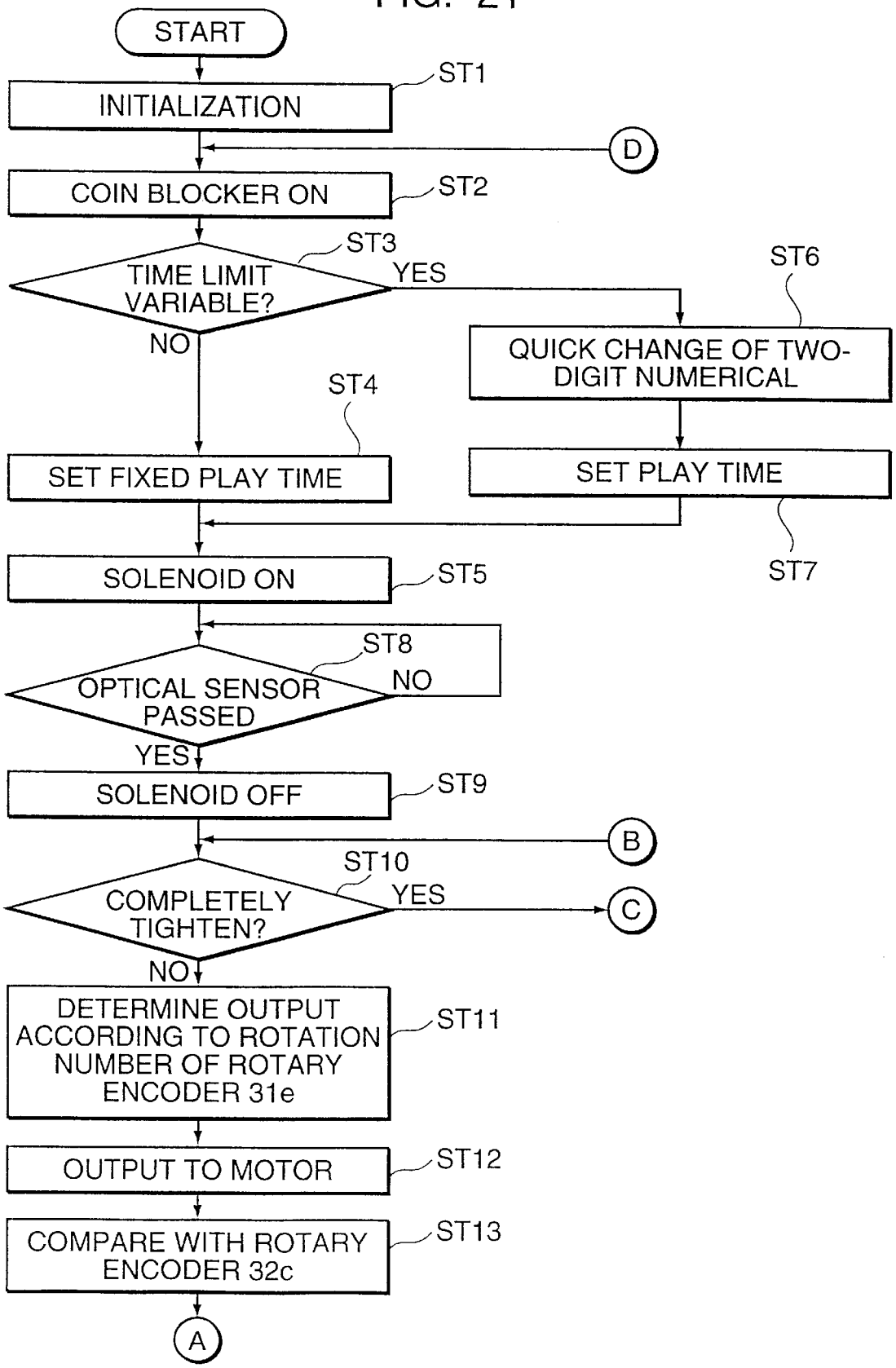
FIGS. 21 and 22 are a flowchart showing a sequence of operations of the gift game machine.
Figure 22:
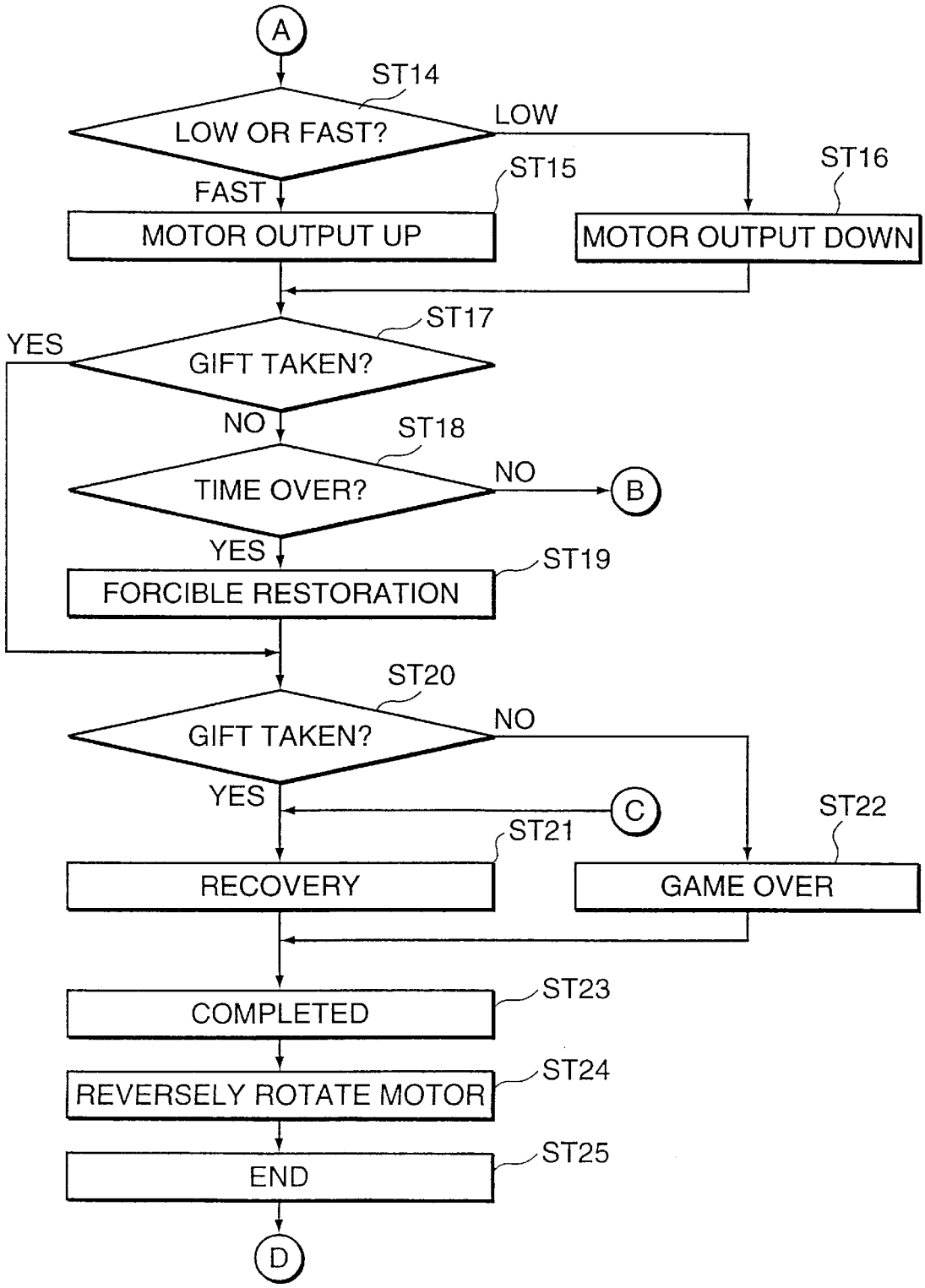

A sequence of operations of the gift game machine will be described with reference to a flowchart shown in FIGS. 21 and 22. When a power switch (not shown) is turned on to start the gift game machine, in Step ST1, the controller 50 initializes each sensor and controls the number display unit 1*g*, the solenoid 28*a*, the speaker 57, and the motor 32. The number display unit 1*g* displays an initial image for determination of time. The speaker 57 outputs predetermined sounds. The solenoid 28*a* sets the catcher 4 in the waiting position A. If the catcher 4 is not accommodated in the accommodation section 23, the motor 22 is driven to move the cord regulator 35 to the rear position D, thereby pulling the connecting cord 5 so that the catcher 4 comes into the waiting position A as shown in FIG. 18. In other words, the length of the connecting cord 5 from the cord guiding unit 36 to the cord regulator 35 becomes longer with the movement of the cord regulator 35 to the rear position D. At the same time, the length of the connecting cord 5 from the catcher 4 to the guiding opening 22*c* becomes shorter as the cord regulator 35 is moved to the rear position D, thereby restoring he catcher 4 to the waiting position A. Thereafter, the cord regulator 35 is moved to the position C where the connecting cord 5 is loosened. The loosened connecting cord 5 is held in the cord guiding channel 37. This state is maintained until a coin is put in.

When a coin is put in, the coin blocker 58*d* is turned ON (Step ST2). It is judged whether the play time variable mode is selected (Step ST3). If the play time fixed mode is selected, the number display unit 1*g* sets a predetermined number (ST4) and the solenoid 28*a* is turned ON (Step ST5). In other words, the extension rod 28*b* is retracted to move the catcher 4 from the waiting position A to the shooting position B. If the play time variable mode is selected at the Step ST3, the number display unit 1*g* displays the image of number quick changing to set a play time (Step ST6). When the start switch 58*c* is turned ON, a play time corresponding to a stopped number is set (Step ST7). This flow proceeds to Step ST5. The number on the number display unit 1*g* is changed as the time elapses.

Next, a target gift article 3 is determined, and the support frame 22 bearing the shooter 20 is rotated in accordance with an expected projectile of the catcher 4 so as to direct the catcher 4 to the target gift article 3. Thereafter, the shooting rod 7 is pulled to a proper extent so that the catcher 4 reaches the target gift article 9. Immediately after the shooting rod 7 is released, the catcher 4 jumps out toward the support table 10. At this time, the connecting cord 5 is loosened while being held in the cord guide channel 37. Accordingly, there is no likelihood that the connecting cord 5 is caught on any projection in the housing 1. The length of the connecting cord 5 is set to be slightly longer than a maximum projectile distance of the catcher 4 so that the connecting cord 5 restricts the movement of the catcher 4.

When the catcher 4 jumps out, the optical sensor 52 detects that the catcher 4 is shot owing to interception of a rear end of the jumping catcher 4 (Step ST8). Conversely, if the optical sensor 52 does not detect interception of the catcher 4, the catcher 4 is judged not to be shot or the shooting is judged to be failure.

If the catcher 4 is detected by the optical sensor 52, the solenoid 28*a* is turned OFF to project the extension rod 28*b* (Step ST9). In other words, if the shooting is judged to be failure (NO in Step ST9), the catcher 4 is returned to the waiting position A.

Next, the knob 31*b* of the operation handle 31 is gripped to thereby rotate the wheel 31*a*. If the catcher 4 rightly catches the target gift article 3, the wheel 31*a* is rotated to move the caught gift article 3 toward the recovery section with so delicate attention that the catcher 4 slips away from the gift article 3. In response to the rotation of the wheel 31*a*, the cord regulator 35 is moved in the rearward direction to pull the connecting cord 5. With the rotation of the wheel 31*a*, specifically, the rotary disk 31*e* of the rotary encoder 31*g* rotates and the controller 50 sets a rotation speed of the motor 32 in accordance with pulses detected by the rotary encoder 31*g*. Consequently, the chain 33 is driven to move the cord regulator 35 toward the rear position D to pull the connecting cord 5. In the case that the catcher 4 is near to catch the target gift article 3, it is first tried to firmly catch the target gift article 3 by rotating the wheel 31*a*. It should be noted that there is a time delay between the start of rotation of the wheel 31*a* and the start of movement of the gift article 3 because some time is consumed until the connecting cord 5 is tightened.

In the meantime, it is judged whether the connecting cord 5 is completely pulled or tightened (Step ST10). The complete tightening is judged based on whether the optical sensor 55 is ON. If the connecting cord 5 is judged not to be completely tightened, a target rotation speed of the motor 32 is determined based on pulses sent from the rotary encoder 31*g* (Step ST11), and the motor 32 is driven to reach the target rotation speed (Step ST12). The target rotation speed is compared with an actual rotation speed of the motor 32 obtained based on pulses sent from the rotary encoder 32*e* (Step ST13). It is judged whether the actual rotation speed of the motor 32 is higher than the target motor rotation speed determined based on the rotary encoder 31*g* (Step ST14). If the actual rotation speed of the motor 32 is lower than the target rotation speed, the motor 32 is driven to increase the actual rotation speed (Step ST15). If the actual rotation speed of the motor 32 is higher than the target rotation speed, the motor 32 is driven to decrease the actual rotation speed (Step ST16). In this way, the actual rotation speed of the motor 32 corresponding to the rotation of the wheel 31*a* is obtained. If the recovery of the gift article 3 is judged to be incomplete, but the play time is not over (Step ST18), the flow returns to Step ST10 and the above-mentioned procedure is repeated.

In this embodiment, a caught gift article 3 is moved or slid in a state that the ring-shaped catcher 4 comes into contact with a lower portion of the ball-shaped gift article 3. Accordingly, there is a possibility that the catcher 4 slips out the bottom of the gift article 3 if a greater pulling force is applied to the catcher 4. Accordingly, the game player is required to regulate the pulling force of the connecting cord 5 to recover the caught gift article 3. However, a slower movement of the gift article 3 involves the time over.

In the course of moving the caught gift article 3 to the recovery section 40, it is necessary to move the gift article 3 on not only the horizontal portion 11 but also the stepped portion 12 connecting the horizontal portion 11. The gift article 3 receives a greater resistance when passing over a boundary between the horizontal portion 11 and the stepped portion 12. Accordingly, a greater pulling force is required to pass this boundary. However, this greater pulling force increases the risk that the catcher 4 slips out from the gift article 3. After the gift article 3 is moved beyond the stepped portion 12, the gift article 3 is moved over the first slant region 13 and then the second slant portion 14 by the catcher 4. In the movement of the gift article 3 over the slanted surface, the ball-shaped gift article 3 is likely to roll down over the slanted surface. Also, the inclination of the second slant portion 14 can be changed, for example, depending on the weight, size or shape of the gift article 3, and the sectional shape or height of the catcher 4. After being moved beyond the second slant portion 14, the caught gift article 3 finally reaches the recovery section 40. The procedure from Steps ST10 to ST18 is repeated until the affirmative judgment is obtained in Steps ST17 or ST18.

If it is judged in the Step ST18 that the play time is over or no play time remains, the forcible restoration is carried out (Step ST19). The cord regulator 35 is moved to the rear position D where the connecting cord 5 is tightened. The tension sensor 36*e* checks that an excessive pulling force is applied to the connecting cord 5. If the movable member 36*d* orients in the horizontal direction or an excessive pulling force is judged to be applied, the controller 50 stops the motor 32.

By the forcible restoration, the catcher 4 is restored in the accommodation section 23. The solenoid 28*a* is turned OFF to thereby project the extension rod 28*b*. Consequently, the catcher 4 is held in the accommodation section 23 at the waiting position A.

If the gift article 3 is not recovered, or the optical sensor 56 detects no gift article 3, an image of game over is displayed on the number display unit 1*g*, and sounds of game over is generated from the speaker (Step ST22).

If the caught gift article 3 is successfully moved in the recovery section 40, and is then fallen to the take-out chamber 43 through the chute 41 and the passage 42, the optical sensor 56 provided in the passage 42 detects the recovery of the gift article 3. When the optical sensor 56 detects the gift article 3 (Step ST20), an image of gift article recovery is displayed on the number display unit 1*g*, and sounds of gift article recovery is generated from the speaker (Step ST21), and the game is ended (Step ST23).

The motor 32 is rotated in the reverse direction to move the cord regulator 35 to the front position C to loosen the tightened connecting cord 5 for next shooting (Step ST24). The reverse rotation of the motor 32 is carried out based on the rotary encoder 32e and is stopped when the cord regulator 35 reaches the front position C. Thus, the game is ended (Step ST25). The flow returns to Step ST1 for next game.

It may be appreciated to provide a plurality of games according to the number of inserted coins, and display the remaining game number on the operation display unit 2*a*.

In this embodiment, one end of the connecting cord 5 is connected with the catcher 4 while the other end of the connecting cord 5 is connected with the fixed support shaft 36*f*. The rotary guiding sleeve 36*b* is rotatably mounted on the fixed support shaft 36*f*. Also, the cord regulator 35 is provided between the rotary guiding sleeve 36*b* and the fixed support shaft 36*f*. The connecting cord 5 is passed through the cord regulator 35. The cord regulator is reciprocatively moved to a specified extent, that is, a range between the front and rear positions C and D to pull or loosen the connecting cord 5. The movement of the cord regulator 35 to the rear position D increases the length of the connecting cord 5 from the rotary guiding sleeve 36*b* to the cord regulator 35 but increasing the length of the connecting cord 5 from the catcher 4 to the rotary guiding sleeve 36*b*, consequently restoring the catcher 4 into the waiting position A of the accommodation section 23. To the contrary, when the cord regulator 35 is moved to the front position C, the length of the connecting cord 5 from the cord regulator 35 to the rotary guiding sleeve 36*b* is decreased to allow the connecting cord 5 to loosen.

The cord regulator 35 is provided between the fixed support shaft 36*j* and the rotary guiding sleeve, which are disposed at the same position. The tension of the connecting cord 5 is regulated by moving the cord regulator 35. Comparing with the conventional moving object restorer, therefore, the movement range of the cord regulator 35 can be reduced to a considerably shorter distance, i.e., around a half. This will make it possible to decrease the size of the game machine greatly.

The connecting cord 5 may be formed by thread, string, a resin flexible rod, a chain of metal rings or resin rings, or the like.

The shape of the guiding members may be modified depending on a game machine.

The present invention is not limited to the foregoing embodiment, but the following modifications may be appreciated.

In the foregoing embodiment, the rotary guiding sleeve 36*b* and the guiding opening 22*c* are used as a guide for the connecting cord 5. However, it may be appreciated to further provide one or two guides in addition to the rotary guiding sleeve 36*b*.

In the foregoing embodiment, the restorer is used in the gift game machine in which a gift article is recovered. However, it may be possible to use the restorer in another various game machines, for example, lottery machine. Also, it may be appreciated to use a magnetic attractor, a vacuuming device, a loop fastener as the moving object. In a case of the restorer being applied for a dart board game machine, it may be appreciated to use a dart as the moving object.

In the foregoing embodiment, the endless chain is used to move the cord regulator. However, it may be possible to use an endless belt, a combination of a rail and a runner running along the rail, or a combination of a rack and a pinion.

Moreover, the inventive restorer may be used for the machines other than game machines that require restoration of a moving object into an original position by a long slender member such as cord.

As described above, an inventive moving object restorer comprises a slender connecting member having one end held at a fixed position and the other end connected with a moving object, a guiding member fixedly provided between the moving object and the fixed position for guiding the slender connecting member. Further, there is provided a regulator between the guiding member and the fixed position. The regulator allows the slender connecting member to pass there through, and is reciprocatively movable between a first position and a second position. The moving object is movable from an original position to a target position spaced from the original position in a state where the regulator is at the first position. The moving object is held at the original position in a state where the regulator is at the second position. The moving object is restored from the target position to the original position while the regulator is moved from the first position to the second position.

In the course of restoration, the movement of the regulator increases the length of the slender connecting member from the fixing position and the regulator and the length of the slender connecting member from the fixed guiding member to the regulator, while decreasing the length of the slender connecting member from the moving object to the fixed guiding member, consequently restoring the moving object into the original position. Accordingly, the moving object can be moved in the restoring direction by moving the regulator in the direction opposite to the restoring direction a distance smaller than the moved distance of the moving object. This is very advantageous in reducing the size of an apparatus or machine on which the moving object restorer is mounted.

In the case that the fixed guiding member is provided at the same position as the fixed position, the moved distance of the regulator can be reduced to substantially a half of the moved distance of the moving object.

There may be provided a restricting member between the moving object and the fixed guiding member. The restricting member serves to restrict the movement course of the slender connecting member to render the moving object to move from the target position to the original position smoothly.

It may be preferable to further provide a driving mechanism for driving the regulator reciprocatively between the first and second positions. This provision makes it possible to move the regulator mechanically without operator's manual operation.

The driving mechanism may be constructed by an endless member, such as chain, belt, fixedly mounted with the regulator, and a motor for driving the endless member. It may be more preferable to provide a tangling preventor under the movement course of the regulator to keep a loosened slender connecting member from tangling. Furthermore, it may be appreciated to further provide a restoration detector for detecting the presence of the moving object, a first position detector for detecting whether the regulator is at the first position, a second position detector for detecting whether the regulator is at the second position, and a controller in responsive to the restoration detector, the first and second position detectors for controlling the driving mechanism. Moreover, there may be further provided an operation unit to be operated by an operator for sending an instruction of the operator in the form of an electric signal to the controller. These constructions can ensure an automatic control restoration operation.

The regulator may be constructed by a base member fixedly mounted on the endless member, and an U-shaped hook fixedly attached on the base member for slidably holding the slender connecting member.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A moving object restorer comprising:

a slender connecting member having one end held at a fixed position and a remaining end connected with a moving object;

a guiding member fixedly provided including guiding structure for guiding the slender connecting member, said fixed position being located on a structural portion of said guide member;

a regulator including a holder portion for slidably holding the slender connecting member at a position along a segment of said slender connecting member extending between said fixed position and said guiding structure, the regulator being movable along a movement course between a first position for allowing the moving object to be moved and a second position for holding the moving object in a restored position.

2. A moving object restorer according to claim 1, further comprising a restricting member fixedly provided between the moving object and the fixed guiding member for restricting the movement course of the slender connecting member.

3. A moving object restorer according to claim 1, further comprising a driving mechanism for moving the regulator reciprocatively between the first and second positions.

4. A moving object restorer according to claim 3, wherein the driving mechanism includes an endless member fixedly mounted with the regulator, and a motor for driving the endless member.

5. A moving object restorer according to claim 4, further comprising a tangling preventor under the movement course of the regulator to keep a loosened slender connecting member from tangling.

6. A moving object restorer according to claim 4, further comprising:

a restoration detector for detecting the presence of the moving object in the restored position;

a first position detector for detecting whether the regulator is at the first position;

a second position detector for detecting whether the regulator is at the second position; and a controller in responsive to the restoration detector, the first and second position detectors for controlling the driving mechanism.

7. A moving object restorer according to claim 4, wherein the regulator includes:

a base member fixedly mounted on the endless member; and an U-shaped hook fixedly attached on the base member for slidably holding the slender connecting member.

8. A moving object restorer comprising:

a slender connecting member having one end held at a fixed position and the other end connected with a moving object;

a guiding member fixedly provided between the moving object and the fixed position for guiding the slender connecting member;

a regulator movably provided between the guiding member and the fixed position, and having a holder portion for holding the slender connecting member slidably, the regulator being movable between a first position for allowing the moving object to be moved and a second position for holding the moving object in a restored position;

a driving mechanism for moving the regulator reciprocatively between the first and second positions, said driving mechanism including an endless member fixedly mounted with the regulator, and a motor for driving the endless member;

a restoration detector for detecting the presence of the moving object in the restored position;

a first position detector for detecting whether the regulator is at the first position;

a second position detector for detecting whether the regulator is at the second position;

a controller in responsive to the restoration detector, the first and second position detectors for controlling the driving mechanism;

an operation member to be operated by an operator, a particular degree of operation by the operator imparting movement to said operation member in an operation amount;

an operation amount detector for detecting said operation amount of the operation member operated by an operator; and a sender for sending a detected operation amount to the controller, said controller controlling the driving mechanism based on the detected operation amount.

9. A moving object restorer comprising:

a slender connecting member having one end held at a fixed position and a remaining end connected with a moving object;

a guiding member fixedly provided between the moving object and the fixed position for guiding the slender connecting member; and a regulator movably provided between the guiding member and the fixed position such that said slender connecting member is guided substantially within a vertical plane between said fixed position and said guiding member, and said regulator having a holder portion for holding the slender connecting member slidably, the regulator being movable between a first position for allowing the moving object to be moved and a second position for holding the moving object in a restored position.

10. A moving object restorer comprising:

a slender connecting member having one end held at a fixed position and a remaining end connected with a moving object;

a guiding member fixedly provided between the moving object and the fixed position for guiding the slender connecting member;

a regulator movably provided between the guiding member and the fixed position, and having a holder portion for holding the slender connecting member slidably, the regulator being movable between a first position for allowing the moving object to be moved and a second position for holding the moving object in a restored position; and driving means for moving said regulator between the first position and the second position, said driving means including a motor and a chain driven by said motor, said regulator being mounted on said chain.

11. A moving object restorer comprising:

a connecting cord including a first end and a second end, said first end being held at a fixed position and said second end being connected to a moving object;

a fixed guiding member including guiding structure for guidably engaging said connecting cord and support structure to which said first end of said connecting cord is fixed at said fixed position; and a regulator including a holder portion for slidably engaging the connector cord at a position along a segment of said connector cord extending between said fixed position on said support structure and said guiding structure, the regulator being movable in at least first and second directions along a movement course, movement of said regulator in said first direction increasing a length of said segment of said connector cord and decreasing a distance of said moving object from said guiding member, and movement of said regulator in said second direction permitting a reduction of a length of said segment when said moving object is moved in a direction away from said guiding member.

* * * * *